US009512841B2

(12) United States Patent
Ogata et al.

(10) Patent No.: US 9,512,841 B2
(45) **Date of Patent: *Dec. 6, 2016**

(54) ROTARY COMPRESSOR WITH OIL RETAINING PORTION

(71) Applicant: Panasonic Intellectual Property Management Co., Ltd., Osaka-shi, Osaka (JP)

(72) Inventors: Takeshi Ogata, Osaka (JP); Yu Shiotani, Osaka (JP); Takumi Hikichi, Osaka (JP); Kentaro Shii, Osaka (JP); Tadayoshi Shoyama, Osaka (JP); Masanobu Wada, Saitama (JP); Hiroshi Hasegawa, Osaka (JP); Hirofumi Yoshida, Shiga (JP); Hiroaki Nakai, Shiga (JP); Akira Hiwata, Shiga (JP); Daisuke Funakosi, Shiga (JP); Ryuichi Ohno, Shiga (JP); Tsuyoshi Karino, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 225 days.

This patent is subject to a terminal disclaimer.

(21) Appl. No.: 14/358,996

(22) PCT Filed: Nov. 14, 2012

(86) PCT No.: PCT/JP2012/007302

§ 371 (c)(1),
(2) Date: May 16, 2014

(87) PCT Pub. No.: WO2013/073183

PCT Pub. Date: May 23, 2013

(65) Prior Publication Data

US 2014/0301881 A1 Oct. 9, 2014

(30) Foreign Application Priority Data

Nov. 16, 2011 (JP) ..... 2011-250262
Aug. 10, 2012 (JP) ..... 2012-177877

(51) Int. Cl.
*F03C 2/00* (2006.01)
*F03C 4/00* (2006.01)

(Continued)

(52) U.S. Cl.
CPC ..... *F04C 29/04* (2013.01); *F01C 21/10* (2013.01); *F04C 18/356* (2013.01);

(Continued)

(58) Field of Classification Search
CPC ..... F04C 29/02; F04C 29/028; F04C 29/04; F04C 29/047; F04C 29/126; F04C 18/356; F04C 23/001; F04C 23/008; F04C 2240/50; F04C 2240/809; F01C 21/10
USPC ..... 418/60, 63, 11, 83, 248, 249, 259, 270, 418/DIG. 1; 184/6.16, 6.18
See application file for complete search history.

(56) References Cited

U.S. PATENT DOCUMENTS 5,230,616 A 7/1993 Serizawa et al.
5,242,280 A 9/1993 Fujio (Continued)

FOREIGN PATENT DOCUMENTS

CN 101684814 3/2010
CN 101835987 9/2010

(Continued)

OTHER PUBLICATIONS

Search Report issued in corresponding Chinese Patent Application No. 201280056574.X, Sep. 21, 2015, 4 pages with translation.

(Continued)

*Primary Examiner* — Theresa Trieu
(74) *Attorney, Agent, or Firm* — Hamre, Schumann, Mueller & Larson, P.C.

(57) ABSTRACT

A rotary compressor (100) includes a closed casing (1), a cylinder (15), a piston (28), a lower bearing member (72), a vane (33), a suction port (20), a discharge port (41), and a partition member (64). The partition member (64) is attached to the lower bearing member (72) so as to form a space enclosed by the partition member (64) and the lower bearing member (72) at a position adjacent to the lower bearing member (72). A portion of an oil stored in the oil reservoir (22) flows into the enclosed space, and thereby an oil retaining portion (53) is formed. The oil retaining portion (53) is located on the same side as the suction port (20) with respect to a reference plane ($H_1$).

13 Claims, 19 Drawing Sheets

(51) Int. Cl.

| | |
|---|---|
| ***F04C 2/00*** | (2006.01) |
| ***F04C 29/04*** | (2006.01) |
| ***F04C 29/02*** | (2006.01) |
| ***F04C 18/356*** | (2006.01) |
| ***F01C 21/10*** | (2006.01) |
| ***F04C 29/12*** | (2006.01) |
| *F04C 23/00* | (2006.01) |

(52) U.S. Cl.
CPC ..... *F04C 29/028* (2013.01); *F04C 29/126* (2013.01); *F04C 23/001* (2013.01); *F04C 23/008* (2013.01); *F04C 2240/50* (2013.01); *F04C 2240/809* (2013.01)

(56) References Cited

U.S. PATENT DOCUMENTS

| | | | | |
|---|---|---|---|---|
| 5,322,424 | A | 6/1994 | Fujio | |
| 7,722,343 | B2 | 5/2010 | Hirayama | |
| 8,342,825 | B2 | 1/2013 | Byun et al. | |
| 2008/0112831 | A1 | 5/2008 | Ogasawara | |
| 2008/0145252 | A1 | 6/2008 | Ku | |
| 2009/0068046 | A1 | 3/2009 | Kishikawa et al. | |
| 2009/0297382 | A1* | 12/2009 | Okaichi | F04C 23/008 418/60 |
| 2010/0215525 | A1 | 8/2010 | Ogasawara et al. | |
| 2010/0226796 | A1* | 9/2010 | Kanayama | F04C 23/008 418/60 |
| 2010/0269536 | A1 | 10/2010 | Wada | |
| 2015/0233376 | A1* | 8/2015 | Ogata | F04C 23/008 418/60 |

FOREIGN PATENT DOCUMENTS

| | | |
|---|---|---|
| EP | I 967 737 | 9/2008 |
| EP | 2 034 131 | 3/2009 |
| JP | 64-000387 | 1/1989 |
| JP | 2-140486 | 5/1990 |
| JP | 4-171279 | 6/1992 |
| JP | 9-158884 | 6/1997 |
| JP | 10-103273 | 4/1998 |
| JP | 2005-256816 | 9/2005 |
| JP | 2007-309146 | 11/2007 |
| JP | 2009-002298 | 1/2009 |
| JP | 2009-002299 | 1/2009 |
| JP | 2012-122452 | 6/2012 |

OTHER PUBLICATIONS

Search Report issued in corresponding Chinese Patent Application No. 201280056562.7, Sep. 2, 2015, 4 pages with and English translation.

Extended European Search Report issued in the corresponding European Patent Application No. 12849536.3 dated Apr. 7, 2015.

* cited by examiner

ROTARY COMPRESSOR WITH OIL RETAINING PORTION

TECHNICAL FIELD

The present invention relates to rotary compressors.

BACKGROUND ART

Rotary compressors are widely used in electrical appliances such as air conditioners, heaters, and hot water dispensers. As one approach to improve the efficiency of rotary compressors, there has been proposed a technique for suppressing so-called heat loss, i.e., a decrease in efficiency caused by the fact that a refrigerant drawn into a compression chamber (a drawn refrigerant) receives heat from the environment.

A rotary compressor of Patent Literature 1 has a closed space provided in a suction-side portion of a cylinder as a means for suppressing heat reception by a drawn refrigerant. The closed space suppresses heat transfer from a high-temperature refrigerant in a closed casing to the inner wall of the cylinder.

CITATION LIST

Patent Literature

Patent Literature 1: JP 02(1990)-140486 A

SUMMARY OF INVENTION

Technical Problem

However, it is not necessarily easy to form a closed space in a cylinder as in Patent Literature 1. Therefore, another technique capable of effectively suppressing heat reception by a drawn refrigerant has been desired.

Solution to Problem

That is, the present disclosure provides a rotary compressor including:

a closed casing having an oil reservoir;

a cylinder disposed inside the closed casing;

a piston disposed inside the cylinder;

a bearing member attached to the cylinder so as to form a cylinder chamber between the cylinder and the piston;

a vane that partitions the cylinder chamber into a suction chamber and a discharge chamber;

a suction port though which a refrigerant to be compressed is introduced into the suction chamber;

a discharge port through which the compressed refrigerant is discharged from the discharge chamber, the discharge port being formed in the bearing member; and a partition member attached to the bearing member so as to form, together with the bearing member, a refrigerant discharge space capable of retaining the refrigerant discharged from the discharge chamber through the discharge port.

In this rotary compressor, the partition member or another member is attached to the bearing member so as to form a space enclosed by the partition member and the bearing member or a space enclosed by the another member and the bearing member at a position adjacent to the bearing member, a portion of an oil stored in the oil reservoir flows into the enclosed space, and thereby an oil retaining portion is formed, and the oil retaining portion is located on the same side as the suction port with respect to a reference plane, the reference plane being a plane including a central axis of the cylinder and a center of the vane when the vane protrudes maximally toward the central axis of the cylinder.

Advantageous Effects of Invention

According to the above-described rotary compressor, a portion of the oil stored in the oil reservoir flows into the space enclosed by the partition member and the bearing member or the space enclosed by the another member and the bearing member, and thereby the oil retaining portion is formed. In addition, the oil retaining portion is located on the same side as the suction port with respect to the reference plane. Once the oil flows into the enclosed space, the oil is allowed to stagnate in the enclosed space. Therefore, the oil retaining portion suppresses heat reception by the bearing member, and accordingly suppresses heat reception by the drawn refrigerant.

DESCRIPTION OF EMBODIMENTS

Figure 1:
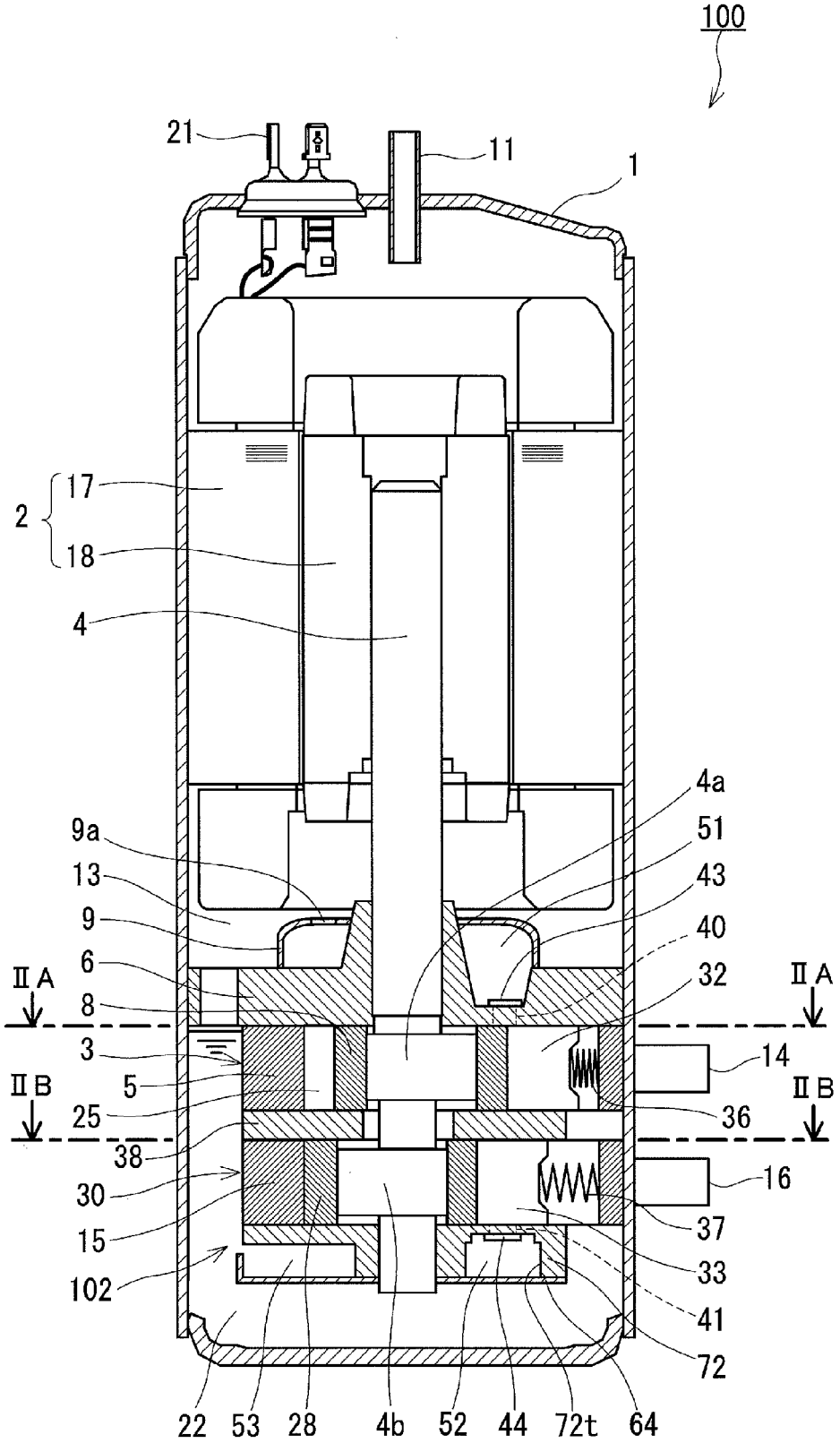
FIG. 1 is a longitudinal cross-sectional view of a rotary compressor according to an embodiment of the present invention.

A first aspect of the present disclosure provides a rotary compressor including:

a closed casing having an oil reservoir;

a cylinder disposed inside the closed casing;

a piston disposed inside the cylinder;

a bearing member attached to the cylinder so as to form a cylinder chamber between the cylinder and the piston;

a vane that partitions the cylinder chamber into a suction chamber and a discharge chamber;

a suction port though which a refrigerant to be compressed is introduced into the suction chamber;

a discharge port through which the compressed refrigerant is discharged from the discharge chamber, the discharge port being formed in the bearing member; and a partition member attached to the bearing member so as to form, together with the bearing member, a refrigerant discharge space capable of retaining the refrigerant discharged from the discharge chamber through the discharge port.

In this rotary compressor, the partition member or another member is attached to the bearing member so as to form a space enclosed by the partition member and the bearing member or a space enclosed by the another member and the bearing member at a position adjacent to the bearing member, a portion of an oil stored in the oil reservoir flows into the enclosed space, and thereby an oil retaining portion is formed, and the oil retaining portion is located on the same side as the suction port with respect to a reference plane, the reference plane being a plane including a central axis of the cylinder and a center of the vane when the vane protrudes maximally toward the central axis of the cylinder.

A second aspect provides the rotary compressor according to the first aspect, wherein the another member may be an oil cup that covers the bearing member so as to form the oil retaining portion. With the use of an oil cup as a member other than the partition member, it is possible to form the oil retaining portion of a relatively simple structure with fewer design constraints.

A third aspect provides the rotary compressor according to the first or second aspect, wherein the rotary compressor may further include a shaft to which the piston is fitted. The bearing member may include a circular plate portion adjacent to the cylinder, a bearing portion formed integrally with the circular plate portion so as to support the shaft, and a bank portion protruding from the circular plate portion so as to surround a recess adapted to serve as the refrigerant discharge space. The refrigerant discharge space can be formed by closing the recess by the partition member. With such a structure, it is possible to reliably separate the refrigerant discharge space from the oil retaining portion.

A fourth aspect provides the rotary compressor according to the first aspect, wherein the another member may be an oil cup that covers the bearing member so as to form the oil retaining portion, the partition member may cover the bearing member so as to form the refrigerant discharge space, and the oil cup may be disposed inside the partition member. With such a structure, it is possible to form the oil retaining portion using a bearing member having the same structure as a bearing member for a conventional rotary compressor.

A fifth aspect provides the rotary compressor according to any one of the first to fourth aspects, wherein the rotary compressor may further include a communication path that communicates the oil reservoir with the oil retaining portion. The oil in the oil reservoir can flow into the oil retaining portion through the communication path.

In a sixth aspect, two planes each including the central axis, each being tangent to the oil retaining portion, and forming an angle within which the oil retaining portion is located are defined as tangent planes, a plane including the central axis and bisecting the angle so as to divide the oil retaining portion into two parts is defined as a bisecting plane, and one of the two parts formed by the bisecting plane is defined as an anterior portion located relatively close to the suction port in a rotational direction of the piston and the other part is defined as a posterior portion located relatively far from the suction port in the rotational direction of the piston. The sixth aspect provides the rotary compressor according to the fifth aspect, wherein the oil in the oil reservoir may flow into the anterior portion only through the posterior portion. The communication path may communicate the oil reservoir with the posterior portion. When the communication path is provided in such a position, heat reception by a drawn refrigerant can be suppressed more effectively.

A seventh aspect provides the rotary compressor according to any one of the first to fourth aspects, wherein the oil retaining portion may include an anterior portion located relatively close to the suction port in a rotational direction of the piston, a posterior portion located relatively far from the suction port in the rotational direction of the piston, and a narrow portion located between the anterior portion and the posterior portion. The narrow portion suppresses the movement of the oil between the anterior portion and the posterior portion. As a result, the flow of the oil in the anterior portion is suppressed, and accordingly heat reception by the drawn refrigerant is also suppressed effectively.

An eighth aspect provides the rotary compressor according to the seventh aspect, wherein the rotary compressor may further include a communication path that communicates the oil reservoir with the oil retaining portion. The communication path may communicate the oil reservoir with the posterior portion. The oil in the oil reservoir may flow into the anterior portion only through the posterior portion and the narrow portion. Thereby, the flow of the oil in the anterior portion is effectively suppressed.

A ninth aspect provides the rotary compressor according to any one of the first to eighth aspects, wherein the bearing member may be provided with a recess and the recess may be closed by the partition member so as to form the refrigerant discharge space. The bearing member may have a larger thickness in the oil retaining portion than in the recess. Thereby, the volume of the discharge port can be reduced sufficiently. This means that the dead volume caused by the discharge port can be reduced.

A tenth aspect provides the rotary compressor according to any one of the first to ninth aspects, wherein in a projection view obtained by projecting the refrigerant discharge space and the oil retaining portion onto a plane perpendicular to the central axis, a projection region of the refrigerant discharge space may have a smaller area than a projection region of the oil retaining portion. With such a configuration, a large heat barrier area can be obtained. Therefore, heat reception by the drawn refrigerant is effectively suppressed.

In an eleventh aspect, (i) the reference plane is defined as a first reference plane, (ii) a plane including the central axis and perpendicular to the first reference plane is defined as a second reference plane, and (iii) four segments obtained by dividing the rotary compressor by the first reference plane and the second reference plane are defined as a first quadrant segment including the suction port, a second quadrant segment including the discharge port, a third quadrant segment opposite to the first quadrant segment and adjacent to the second quadrant segment, and a fourth quadrant segment opposite to the second quadrant segment and adjacent to the first quadrant segment, respectively. The eleventh aspect provides the rotary compressor according to any one of the first to tenth aspects, wherein in a projection view obtained by projecting the first to fourth quadrant segments and the refrigerant discharge space onto a plane perpendicular to the central axis, an entire projection region of the refrigerant discharge space may fall within a combined region consisting of a projection region of the first quadrant segment, a projection region of the second quadrant segment, and a projection region of the third quadrant segment. With such a configuration, heat reception by the drawn refrigerant can be suppressed, with an increase in pressure loss being suppressed.

In a twelfth aspect, (a) the reference plane is defined as a first reference plane, (b) a plane including the central axis and a center of the suction port is defined as a third reference plane, (c) one of two segments obtained by dividing the rotary compressor by the first reference plane is defined as a first high-temperature segment including the discharge port, (d) one of two segments obtained by dividing the rotary compressor by the third reference plane is defined as a second high-temperature segment including the discharge port, and (e) three of four segments obtained by dividing the rotary compressor by the first reference plane and the third reference plane are collectively defined as a combined high-temperature segment, the three segments being included in the first high-temperature segment or the second high-temperature segment. The twelfth aspect provides the rotary compressor according to any one of the first to eleventh aspects, wherein in a projection view obtained by projecting the combined high-temperature segment and the refrigerant discharge space onto a plane perpendicular to the central axis, 70% or more of a projection region of the refrigerant discharge space may overlap a projection region of the combined high-temperature segment. With such a configuration, the total loss including heat reception by the drawn refrigerant (heat loss) and pressure loss can be minimized.

A thirteenth aspect provides the rotary compressor according to any one of the first to twelfth aspects, wherein the rotary compressor may further include a shaft to which the piston is fitted. This rotary compressor may be a vertical rotary compressor in which a rotational axis of the shaft is parallel to a direction of gravity and the oil reservoir is formed at a bottom of the closed casing. In the vertical rotary compressor, the oil retaining portion is less likely to be affected by swirling flow generated by a motor that drives the shaft.

Hereinafter, an embodiment of the present invention will be described with reference to the drawings. The present invention is not limited to the embodiment given below.

As shown in FIG. 1, a rotary compressor 100 of the present embodiment includes a closed casing 1, a motor 2, a compression mechanism 102, and a shaft 4. The compression mechanism 102 is disposed in the lower part of the closed casing 1. The motor 2 is disposed above the compression mechanism 102 inside the closed casing 1. The compression mechanism 102 and the motor 2 are coupled together by the shaft 4. A terminal 21 for supplying electric power to the motor 2 is provided on the upper part of the closed casing 1. An oil reservoir 22 for holding lubricating oil is formed at the bottom of the closed casing 1.

The motor 2 is composed of a stator 17 and a rotor 18. The stator 17 is fixed to the inner wall of the closed casing 1. The rotor 18 is fixed to the shaft 4, and rotates together with the shaft 4.

A discharge pipe 11 is provided in the upper part of the closed casing 1. The discharge pipe 11 penetrates the upper part of the closed casing 1, and opens into an internal space 13 of the closed casing 1. The discharge pipe 11 serves as a discharge flow path for discharging the refrigerant compressed in the compression mechanism 102 to the outside of the closed casing 1. During the operation of the rotary compressor 100, the internal space 13 of the closed casing 1 is filled with the compressed refrigerant.

The compression mechanism 102 is driven by the motor 2 to compress the refrigerant. Specifically, the compression mechanism 102 has a first compression block 3, a second compression block 30, an upper bearing member 6, a lower bearing member 72, an intermediate plate 38, a first partition member 9 (a first muffler or a first closing member), and a second partition member 64 (a second muffler or a second closing member). The refrigerant is compressed in the first compression block 3 or the second compression block 30. The first compression block 3 and the second compression block 30 are immersed in the oil stored in the oil reservoir 22. In the present embodiment, the first compression block 3 is composed of the same components as those of the second compression block 30. Therefore, the first compression block 3 has the same suction volume as that of the second compression block 30.

Figure 2A:
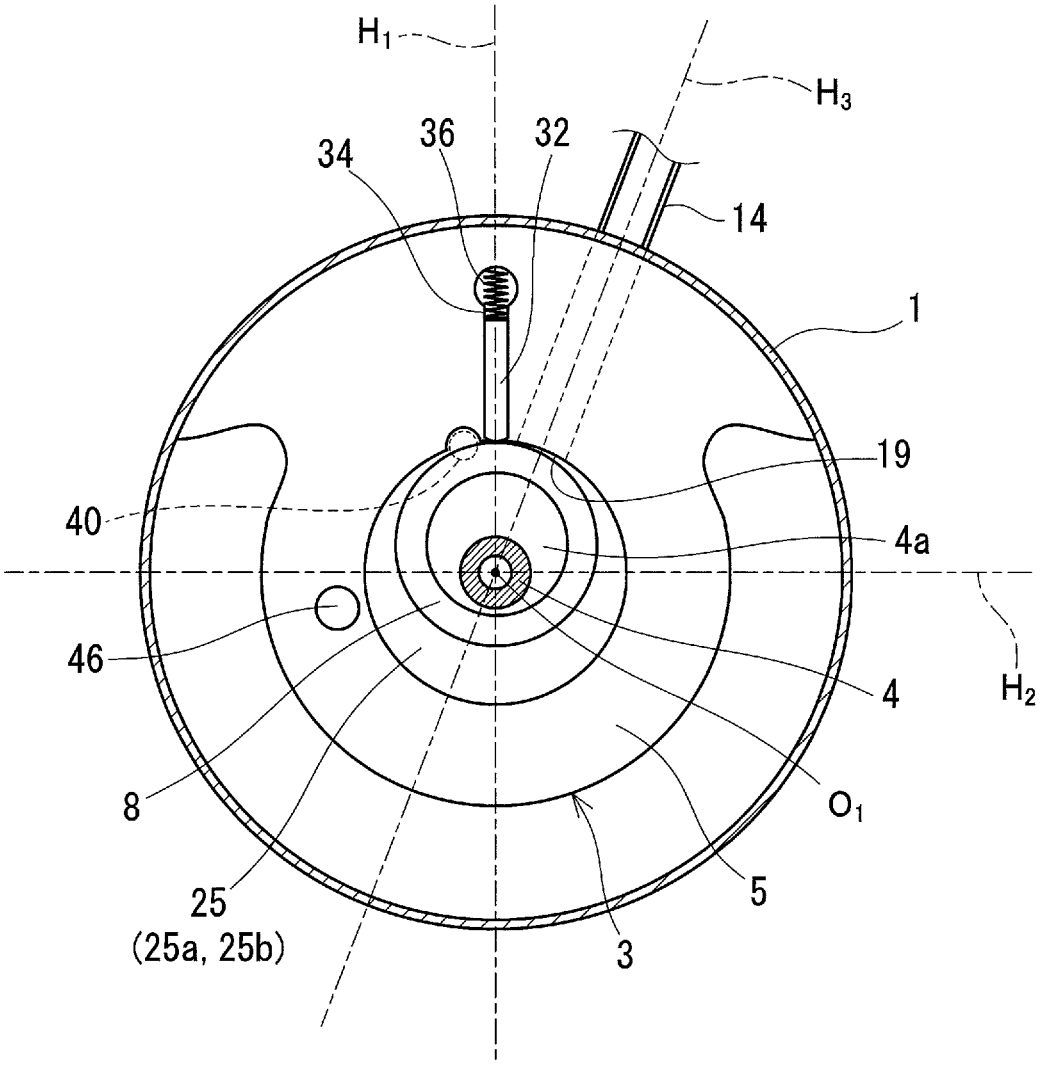
FIG. 2A is a transverse cross-sectional view of the rotary compressor shown in FIG. 1 taken along the line IIA-IIA.
Figure 2B:
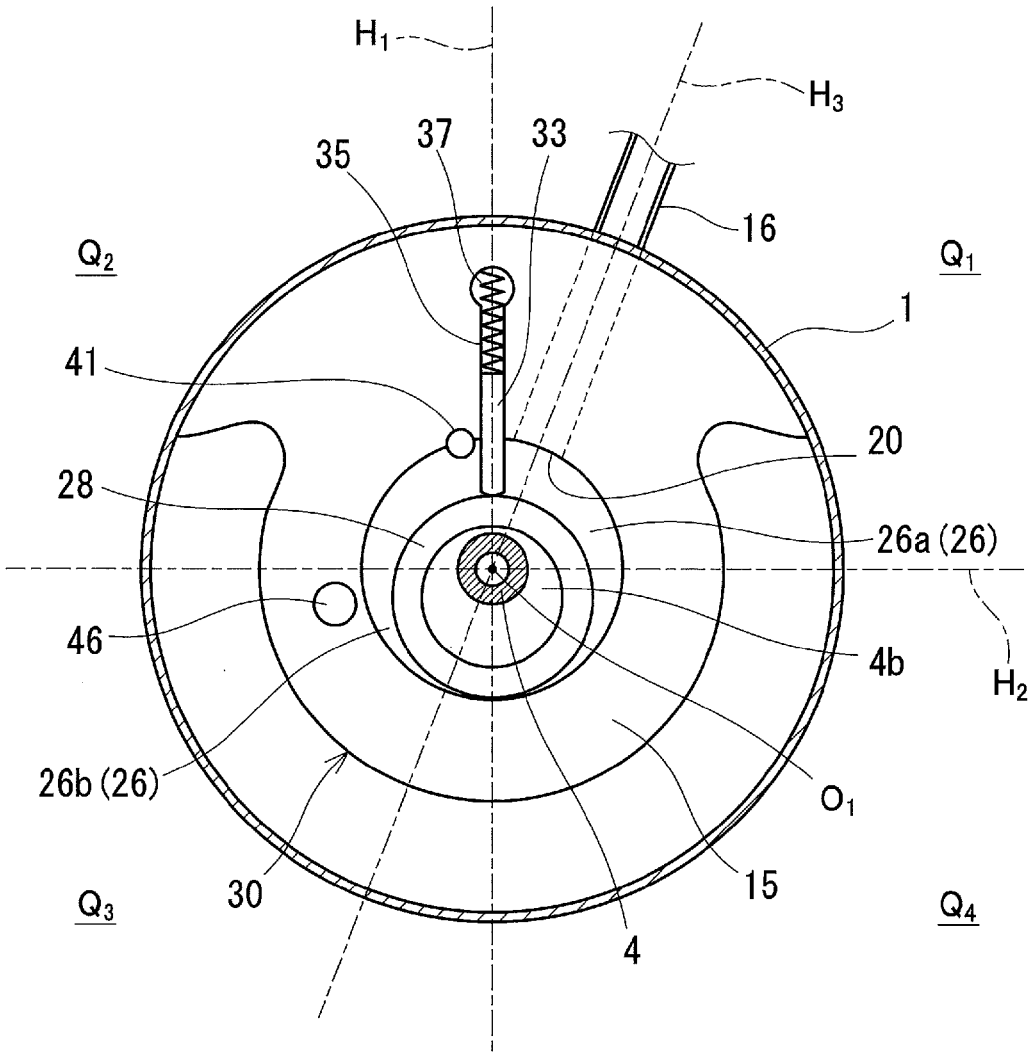
FIG. 2B is a transverse cross-sectional view of the rotary compressor shown in FIG. 1 taken along the line IIB-IIB.

As shown in FIG. 2A, the first compression block 3 is composed of a first cylinder 5, a first piston 8, a first vane 32, a first suction port 19, a first discharge port 40, and a first spring 36. As shown in FIG. 2B, the second compression block 30 is composed of a second cylinder 15, a second piston 28, a second vane 33, a second suction port 20, a second discharge port 41, and a second spring 37. The first cylinder 5 and the second cylinder 15 are disposed vertically concentrically.

The shaft 4 has a first eccentric portion 4*a* and a second eccentric portion 4*b*. The eccentric portions 4*a* and 4*b* each protrude radially outward. The first piston 8 and the second piston 28 are disposed inside the first cylinder 5 and the second cylinder 15, respectively. In the first cylinder 5, the first piston 8 is fitted to the first eccentric portion 4*a*. In the second cylinder 15, the second piston 28 is fitted to the second eccentric portion 4*b*. A first vane groove 34 and a second vane groove 35 are formed in the first cylinder 5 and the second cylinder 15, respectively. In the rotational direction of the shaft 4, the position of the first vane groove 34 coincides with the position of the second vane groove 35. The first eccentric portion 4*a* protrudes in a direction 180 degrees opposite to the direction in which the second eccentric portion 4*b* protrudes. That is, the phase difference between the first piston 8 and the second piston 28 is 180 degrees. This configuration is effective in reducing vibration and noise.

The upper bearing member 6 is attached to the first cylinder 5 so as to form a first cylinder chamber 25 between the inner circumferential surface of the first cylinder 5 and the outer circumferential surface of the first piston 8. The lower bearing member 72 is attached to the second cylinder 15 so as to form a second cylinder chamber 26 between the inner circumferential surface of the second cylinder 15 and the outer circumferential surface of the second piston 28. More specifically, the upper bearing member 6 is attached to the top of the first cylinder 5, and the lower bearing member 72 is attached to the bottom of the second cylinder 15. The intermediate plate 38 is disposed between the first cylinder 5 and the second cylinder 15.

The first suction port 19 and the second suction port 20 are formed in the first cylinder 5 and the second cylinder 15, respectively. The first suction port 19 and the second suction port 20 open into the first cylinder chamber 25 and the second cylinder chamber 26, respectively. A first suction pipe 14 and a second suction pipe 16 are connected to the first suction port 19 and the second suction port 20, respectively.

The first discharge port 40 and the second discharge port 41 are formed in the upper bearing member 6 and the lower bearing member 72, respectively. The first discharge port 40 and the second discharge port 41 open into the first cylinder chamber 25 and the second cylinder chamber 26, respectively. The first discharge port 40 is provided with a first discharge valve 43 so as to open and close the first discharge port 40. The second discharge port 41 is provided with a second discharge valve 44 so as to open and close the second discharge port 41.

A first vane 32 (blade) is slidably fitted in the first vane groove 34. The first vane 32 partitions the first cylinder chamber 25 in the circumferential direction of the first piston 8. That is, the first cylinder chamber 25 is partitioned into a first suction chamber 25*a* and a first discharge chamber 25*b*. A second vane 33 (blade) is slidably fitted in the second vane groove 35. The second vane 33 partitions the second cylinder chamber 26 in the circumferential direction of the second piston 28. That is, the second cylinder chamber 26 is partitioned into a second suction chamber 26*a* and a second discharge chamber 26*b*. The first suction port 19 and the first discharge port 40 are located on both sides of the first vane 32. The second suction port 20 and the second discharge port 41 are located on both sides of the second vane 33. The refrigerant to be compressed is supplied to the first cylinder chamber 25 (first suction chamber 25*a*) through the first suction port 19. The refrigerant to be compressed is supplied to the second cylinder chamber 26 (second suction chamber 26*a*) through the second suction port 20. The refrigerant compressed in the first cylinder chamber 25 pushes the first discharge valve 43 open, and is discharged from the first discharge chamber 25*b* through the first discharge port 40. The refrigerant compressed in the second cylinder chamber 26 pushes the second discharge valve 44 open, and is discharged from the second discharge chamber 26*b* through the second discharge port 41.

The first piston 8 and the first vane 32 may constitute a single component, a so-called swing piston. The second piston 28 and the second vane 33 may constitute a single component, a so-called swing piston. The first vane 32 and the second vane 33 may be coupled to the first piston 8 and the second piston 28, respectively. The specific type of the rotary compressor is not particularly limited, and a wide variety of types of rotary compressors, such as a rolling piston type rotary compressor and a swing piston type rotary compressor, can be used.

The first spring 36 and the second spring 37 are disposed behind the first vane 32 and the second vane 33, respectively. The first spring 36 and the second spring 37 push the first vane 32 and the second vane 33, respectively, toward the center of the shaft 4. The rear end of the first vane groove 34 and the rear end of the second vane groove 35 each communicate with the internal space 13 of the closed casing 1. Therefore, the pressure in the internal space 13 of the closed casing 1 is applied to the rear surface of the first vane 32 and the rear surface of the second vane 33. The oil stored in the oil reservoir 22 is supplied to the first vane groove 34 and the second vane groove 35.

As shown in FIG. 1, the first partition member 9 is attached to the upper bearing member 6 so as to form, on the opposite side to the first cylinder chamber 25 with respect to the upper bearing member 6, a refrigerant discharge space 51 capable of retaining the refrigerant discharged from the first discharge chamber 25*b* through the first discharge port 40. More specifically, the first partition member 9 is attached to the top of the upper bearing member 6 so as to form the refrigerant discharge space 51 above the upper bearing member 6. The first partition member 9, together with the upper bearing member 6, forms the refrigerant discharge space 51. The first discharge valve 43 is covered by the first partition member 9. A discharge port 9*a*, for introducing the refrigerant from the refrigerant discharge space 51 into the internal space 13 of the closed casing 1, is formed in the first partition member 9. The second partition member 64 is attached to the lower bearing member 72 so as to form, on the opposite side to the second cylinder chamber 26 with respect to the lower bearing member 72, a refrigerant discharge space 52 capable of retaining the refrigerant discharged from the second discharge chamber 26*b* through the second discharge port 41. More specifically, the second partition member 64 is attached to the bottom of the lower bearing member 72 so as to form the refrigerant discharge space 52 below the lower bearing member 72. The second partition member 64, together with the lower bearing member 72, forms the refrigerant discharge space 52. The second discharge valve 44 is covered by the second partition member 64. The refrigerant discharge spaces 51 and 52 each serve as a flow path for the refrigerant. The shaft 4 penetrates the central portion of the first partition member 9 and the central portion of the second partition member 64, and is rotatably supported by the upper bearing member 6 and the lower bearing member 72.

The refrigerant discharge space 52 communicates with the refrigerant discharge space 51 via a through flow path 46. The through flow path 46 penetrates through the lower bearing member 72, the second cylinder 15, the intermediate plate 38, the first cylinder 5, and the upper bearing member 6, in a direction parallel to the rotational axis of the shaft 4. The refrigerant compressed in the second compression block 30 and the refrigerant compressed in the first compression block 3 are merged together in the internal space of the first partition member 9, that is, the refrigerant discharge space 51. Therefore, even if the volume of the refrigerant discharge space 52 is slightly smaller than the required volume, the silencing effect by the refrigerant discharge space 51 can be obtained within the first partition member 9. The cross-sectional area of the through flow path 46 (flow path area) is larger than the cross-sectional area (flow path area) of the second discharge port 41. Therefore, an increase in the pressure loss can be prevented.

As shown in FIG. 2B, in the present description, a first reference plane $H_1$, a second reference plane $H_2$, and a third reference plane $H_3$ are defined as follows. A plane including the central axis $O_1$ of the second cylinder 15 and the center of the second vane 33 when the second vane 33 protrudes maximally toward the central axis $O_1$ of the second cylinder 15 is defined as the first reference plane $H_1$. The first reference plane $H_1$ passes through the center of the second vane groove 35. A plane including the central axis $O_1$ and perpendicular to the first reference plane $H_1$ is defined as the second reference plane $H_2$. A plane including the central axis $O_1$ and the center of the second suction port 20 is defined as the third reference plane $H_3$. The central axis $O_1$ of the second cylinder 15 almost coincides with the rotational axis of the shaft 4 and the central axis of the first cylinder 5.

The second vane groove 35 has an opening that faces the second cylinder chamber 26. When the position of the center of the opening of the second vane groove 35 is defined as a reference position in the circumferential direction of the inner circumferential surface of the second cylinder 15, the first reference plane $H_1$ can be a plane passing through this reference position and including the central axis $O_1$. That is, the "center of the second vane groove 35" refers to the center of the opening of the second vane groove 35. The first reference plane $H_1$ can be a plane including the central axis $O_1$ of the second cylinder 15 and a point of contact (specifically, a tangent line) between the second cylinder 15 and the second piston 28 when the second vane 33 protrudes maximally toward the central axis $O_1$ of the second cylinder 15. The central axis $O_1$ of the second cylinder 15 specifically refers to the central axis of the cylindrical inner circumferential surface of the second cylinder 15.

As shown in FIG. 1, the compression mechanism 102 further includes an oil retaining portion 53. The oil retaining portion 53 is located on the same side as the second suction port 20 with respect to the first reference plane $H_1$. The oil retaining portion 53 is formed on the opposite side to the second cylinder chamber 26 with respect to the lower bearing member 72. More specifically, the oil retaining portion 53 is in contact with the lower surface of the lower bearing member 72. The second partition member 64 (or another member other than the second partition member 64) is attached to the lower bearing member 72, and thereby a space enclosed by the second partition member 64 (or the another member) and the lower bearing member 72 is formed at a position adjacent to the lower bearing member 72. Then, a portion of the oil stored in the oil reservoir 22 flows into the enclosed space, and thereby the oil retaining portion 53 is formed. The oil retaining portion 53 is configured to slow down the flow of the oil in this oil retaining portion 53 compared to the flow of the oil in the oil reservoir 22. The flow of the oil in the oil retaining portion 53 is slower than that of the oil in the oil reservoir 22.

In the rotary compressor 100, the level of the oil in the oil reservoir 22 is higher than the lower surface of the first cylinder 5. In order to ensure reliability, it is desirable that the level of the oil in the oil reservoir 22 be higher than the upper surface of the first cylinder 5 and lower than the lower end of the motor 2 during the operation. The second cylinder 15, the lower bearing member 72, and the second partition member 64 are immersed in the oil in the oil reservoir 22. Therefore, the oil in the oil reservoir 22 can flow into the oil retaining portion 53.

The refrigerant to be compressed is in a low-temperature and low-pressure state. On the other hand, the compressed refrigerant is in a high-temperature and high-pressure state. Therefore, during the operation of the rotary compressor 100, the lower bearing member 72 has a certain temperature distribution. Specifically, when the lower bearing member 72 is divided into a suction-side portion and a discharge-side portion, the former has a relatively low temperature and the latter has a relatively high temperature. When the lower bearing member 72 is divided into two parts by the first reference plane $H_1$, the suction-side portion is one part including a portion directly below the second suction port 20. The discharge-side portion is the other part having the second discharge port 41 formed therein.

In the present embodiment, the oil retaining portion 53 is formed on the same side as the second suction port 20 with respect to the first reference plane $H_1$. The oil retaining portion 53 is in contact with the lower surface of the lower bearing member 72. The oil in the oil retaining portion 53 suppresses reception of heat from the environment by the refrigerant drawn into the second cylinder chamber 26 (drawn refrigerant). More specifically, the oil retaining portion 53 suppresses heat reception by the drawn refrigerant mainly for the following reasons.

Oil is a liquid and has a high viscosity. Once the oil in the oil reservoir 22 flows into the space forming the oil retaining portion 53, the oil is allowed to stagnate in the oil retaining portion 53. Therefore, the flow speed of the oil in the oil retaining portion 53 is lower than that of the oil in the oil reservoir 22. In general, the heat transfer coefficient on the surface of a substance is proportional to the square root of the flow speed of a fluid. Therefore, when the flow speed of the oil in the oil retaining portion 53 is low, the heat transfer coefficient on the lower surface of the lower bearing member 72 is also low. As a result, the heat is transferred slowly from the oil in the oil retaining portion 53 to the lower bearing member 72. Since the lower bearing member 72 is hard to receive the heat from the oil, reception of the heat by the drawn refrigerant from the lower bearing member 72 is also suppressed. For this reason, the oil retaining portion 53 suppresses the heat reception by the drawn refrigerant. Even if another member is disposed between the oil retaining portion 53 and the lower surface of the lower bearing member 72, the another member can be regarded as a part of the lower bearing member 72.

The effect of suppressing the heat reception by the drawn refrigerant also results from not only the oil retaining portion 53 but also the fact that most of the refrigerant discharge space 52 is formed on the same side as the second discharge port 41 with respect to the first reference plane $H_1$. This means that the present embodiment makes it possible to increase the distance over which the heat of the discharged refrigerant is transferred to the drawn refrigerant. More specifically, the heat needs to be transferred through a heat transfer path inside the lower bearing member 72 to transfer the heat from the discharged refrigerant in the refrigerant discharge space 52 to the drawn refrigerant in the second suction chamber 26*a*. In the present embodiment, the heat transfer path is relatively long. According to the Fourier's law, the amount of heat transfer is inversely proportional to the distance of the heat transfer path. This means that the present embodiment makes it possible to increase the heat resistance of the heat transfer from the discharged refrigerant to the drawn refrigerant.

In addition, the oil retaining portion 53 allows the closed casing 1 to store extra oil in an amount equal to the volume of the oil retaining portion 53. Therefore, the oil retaining portion 53 contributes to an improvement in the reliability of the rotary compressor 100.

Figure 3:
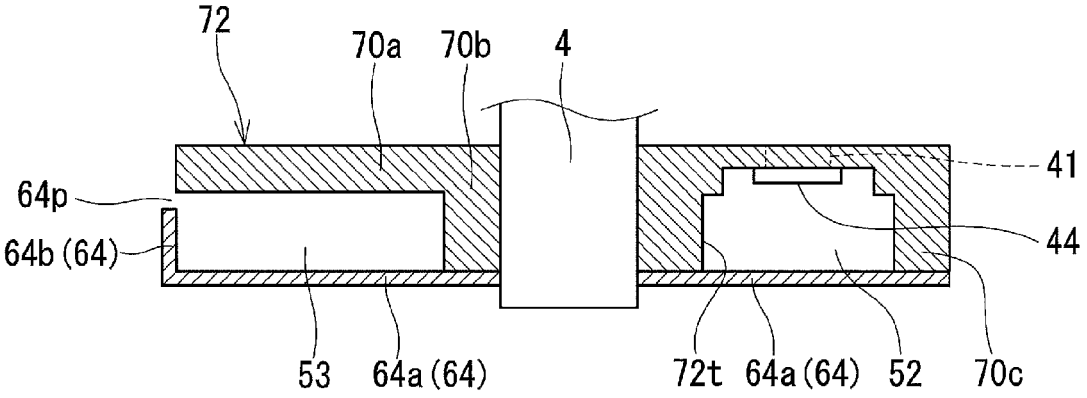
FIG. 3 is a partial cross-sectional view of the rotary compressor shown in FIG. 1.
Figure 4:
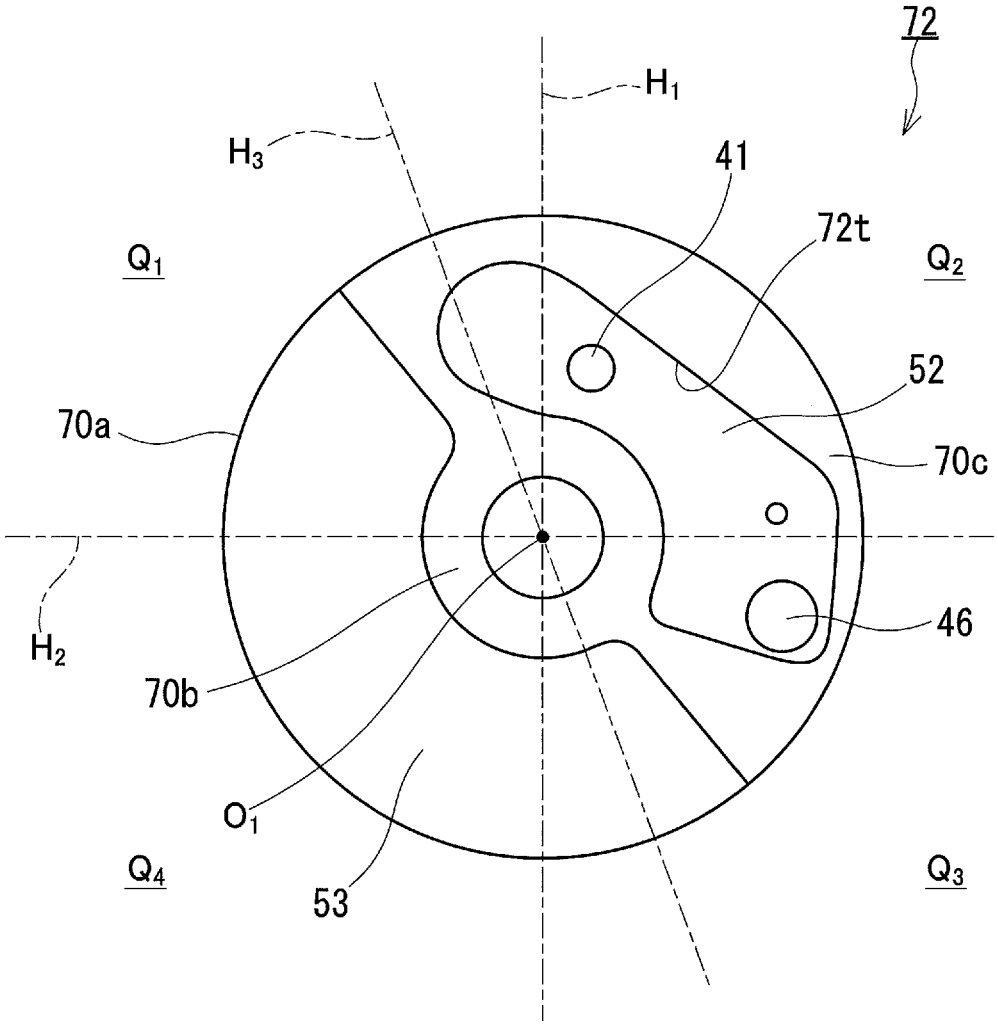
FIG. 4 is a bottom view of a lower bearing member.

As shown in FIG. 3 and FIG. 4, the lower bearing member 72 includes a circular plate portion 70*a*, a bearing portion

70*b*, and a bank portion 70*c*. The circular plate portion 70*a* is a portion adjacent to the second cylinder 15. The second discharge port 41 is formed in the circular plate portion 70*a*. The second discharge valve 44 that opens and closes the second discharge port 41 is attached to the circular plate portion 70*a*. The bearing portion 70*b* is a hollow cylindrical portion that is formed integrally with the circular plate portion 70*a* so as to support the shaft 4. The bank portion 70*c* is a portion protruding from the circular plate portion 70*a* so as to surround the recess 72*t* adapted to serve as the refrigerant discharge space 52. The open end face of the bank portion 70*c* is a flat surface.

The second partition member 64 has a circular shape in plane view, and has, in the central portion thereof, a through hole into which the shaft 4 is inserted. Specifically, the second partition member 64 is composed of a plate-shaped portion 64*a* (bottom portion) and an arc-shaped portion 64*b* (side wall portion). The second partition member 64 is attached to the lower bearing member 72 so as to form the refrigerant discharge space 52 and the oil retaining portion 53 respectively on the opposite side to the second cylinder chamber 26 with respect to the lower bearing member 72. A part of the plate-like portion 64*a* is in contact with the bank portion 70*c* and closes the recess 72*t* surrounded by the bearing portion 70*b* and the bank portion 70*c*. The rest of the plate-like portion 64*a* faces the circular plate portion 70*a* of the lower bearing member 72 so as to form the oil retaining portion 53. The arc-shaped portion 64*b* is a portion that is formed integrally with the plate-like portion 64*a*, and is formed along the outer edge of the plate-like portion 64*a*. The arc-shaped portion 64*b* further extends in the thickness direction of the plate-like portion 64*a* (in a direction parallel to the rotational axis of the shaft 4). A gap 64*p* serving as a communication path communicating the oil reservoir 22 with the oil retaining portion 53 is formed between the end of the arc-shaped portion 64*b* and the lower bearing member 72. The size of the communication path 7*p* (the width of the gap 64*p*) is adjusted to a size necessary and sufficient for the oil in the oil reservoir 22 to flow into the oil retaining portion 53. Therefore, the flow of the oil in the oil retaining portion 53 is slower than that of the oil in the oil reservoir 22. As a result, relatively stable thermal stratification of the oil is observed in the oil retaining portion 53.

As shown in FIG. 4, the oil retaining portion 53 is formed in a certain angular range around the shaft 4, and the refrigerant discharge space 52 is formed in the remaining angular range. However, a part of the oil retaining portion 53 and a part of the refrigerant discharge space may overlap each other in the circumferential direction of the shaft 4. The oil retaining portion 53 is completely separated from the refrigerant discharge space 52 by the bank portion 70*c* of the lower bearing member 72. Most of the refrigerant discharge space 52 is formed on the same side as the second discharge port 41 with respect to the first reference plane $H_1$. On the other hand, the oil retaining portion 53 is formed on the same side as the second suction port 20 with respect to the first reference plane $H_1$.

When the refrigerant discharge space 52 and the oil retaining portion 53 are in such a positional relationship, the heat transfer from the refrigerant discharged into the refrigerant discharge space 52 to the refrigerant drawn into the second cylinder chamber 26 can be suppressed.

In the present embodiment, a part of the oil retaining portion 53 is formed on the same side as the second discharge port 41 with respect to the first reference plane $H_1$. However, the entire oil retaining portion 53 may be formed on the same side as the second suction port 20 with respect to the first reference plane $H_1$.

As shown in FIG. 3, the thickness of a portion of the lower bearing member 72 in which the oil retaining portion 53 is formed is larger than the thickness of a portion of the lower bearing member 72 in which the refrigerant discharge space 52 is formed. Thereby, the volume of the second discharge port 41 can be reduced sufficiently. This means that the dead volume caused by the second discharge port 41 can be reduced. When the minimum thickness of the portion of the lower bearing member 72 in which the refrigerant discharge space 52 is formed is D1 and the minimum thickness of the portion of the lower bearing member 72 in which the oil retaining portion 53 is formed is D2, for example, the following relation holds: $1.1 \leq (D2/D1) \leq 40$ (or $1.5 \leq (D2/D1) \leq 40$). The "thickness of the lower bearing member 72" refers to the thickness thereof in the direction parallel to the rotational axis of the shaft 4.

The occupancies of the refrigerant discharge space 52 and the oil retaining portion 53 in the lower bearing member 72 are not particularly limited. For example, in a projection view obtained by (orthogonally) projecting the refrigerant discharge space 52 and the oil retaining portion 53 onto a plane perpendicular to the central axis $O_1$, the area of the projection region of the refrigerant discharge space 52 may be larger than the area of the projection region of the oil retaining portion 53. Such a configuration is desirable in suppressing an increase in the pressure loss of the refrigerant.

On the other hand, in the projection view obtained by (orthogonally) projecting the refrigerant discharge space 52 and the oil retaining portion 53 onto a plane perpendicular to the central axis $O_1$, the area $S_3$ of the projection region of the refrigerant discharge space 52 may be smaller than the area $S_4$ of the projection region of the oil retaining portion 53. Such a configuration is desirable in suppressing heat reception by the drawn refrigerant. The area $S_3$ and the area $S_4$ satisfy the relation $1.1 \leq (S_4/S_3) \leq 5$, for example. When the volume of the refrigerant discharge space 52 is $V_3$ and the volume of the oil retaining portion 53 is $V_4$, they satisfy the relation $1.1 \leq (V_4/V_3) \leq 10$, for example. When the oil retaining portion 53 has a sufficiently large area and/or volume, the effect of suppressing heat reception by the drawn refrigerant can be fully obtained. It should be noted that the area $S_3$ may be equal to the area $S_4$. The volume $V_3$ may be equal to the volume $V_4$.

The positions of the refrigerant discharge space 52 and the oil retaining portion 53 are described in further detail.

As shown in FIG. 2B, when the rotary compressor 100 is divided into four segments by the first reference plane $H_1$ and the second reference plane $H_2$, and one of the four segments that includes the second suction port 20 is defined as a first quadrant segment $Q_1$. One of the four segments that includes the second discharge port 41 is defined as a second quadrant segment $Q_2$. One of the four segments that is opposite to the first quadrant segment $Q_4$ and adjacent to the second quadrant segment $Q_2$ is defined as a third quadrant segment $Q_3$. One of the four segments that is opposite to the second quadrant segment $Q_2$ and adjacent to the first quadrant segment $Q_4$ is defined as a fourth quadrant segment $Q_4$.

FIG. 4 is a bottom view of the lower bearing member 72. FIG. 4 corresponds to the projection view obtained by (orthogonally) projecting the first to fourth quadrant segments $Q_4$ to $Q_4$, the refrigerant discharge space 52, and the oil retaining portion 53 onto a plane perpendicular to the central axis $O_4$, although right and left are reversed in FIG. 4 and the projection view. In the present embodiment, in this projection view, the entire projection region of the refrigerant discharge space 52 falls within a combined region consisting of a projection region of the first quadrant segment $Q_4$, a projection region of the second quadrant segment $Q_2$, and a projection region of the third quadrant segment $Q_3$. The entire projection region of the oil retaining portion 53 falls within a combined region consisting of the projection region of the first quadrant segment $Q_4$, the projection region of the third quadrant segment $Q_3$, and a projection region of the fourth quadrant segment $Q_4$. As described above, the projection regions of the second quadrant segment $Q_2$ and the third quadrant segment $Q_3$ correspond to the discharge-side portion having a relatively high temperature. It makes a certain amount of sense that the refrigerant discharge space 52 is formed in the second quadrant segment $Q_2$ and the third quadrant segment $Q_3$. The through flow path 46 opens into the refrigerant discharge space 52 in the third quadrant segment $Q_3$, for example. The through flow path 46 may open into the refrigerant discharge space 52 in the second quadrant segment $Q_2$.

As shown in FIG. 4, in the present embodiment, the refrigerant discharge space 52 extends beyond the first reference plane $H_1$ and overlaps the third reference plane $H_3$. This means that a part of the refrigerant discharge space 52 is located directly below the second suction port 20. Such a configuration is not necessarily preferable in suppressing heat transfer (heat loss) from the refrigerant in the refrigerant discharge space 52 to the refrigerant in the second cylinder chamber 26. However, this configuration can be accepted for the following reason.

In a typical rotary compressor, a suction port and a discharge port are provided as close to a vane as possible in order to avoid formation of a dead volume. The refrigerant discharge space is formed below the lower bearing member, and the discharge port opens into the refrigerant discharge space. It is desirable that the refrigerant discharge space be formed only on the same side as the discharge port with respect to the first reference plane $H_1$ in order to reduce the heat loss. On the other hand, in order to reduce the pressure loss, it is desirable that there be a sufficiently large space around the discharge port. If the range of the refrigerant discharge space is limited in view of the heat loss, the space around the discharge port becomes insufficient, which may cause a significant increase in the pressure loss. That is, there is a trade-off relationship between the reduction of the heat loss and the reduction of the pressure loss.

In the present embodiment, a part of the refrigerant discharge space 52 is allowed to be located directly below the second suction port 20 for the purpose of reducing the pressure loss. The effect of reducing the heat loss can be obtained at least as long as the refrigerant discharge space 52 is not present in the projection region of the fourth quadrant segment $Q_4$.

From another point of view, the position of the refrigerant discharge space 52 can be determined in the following manner.

Figure 5A:
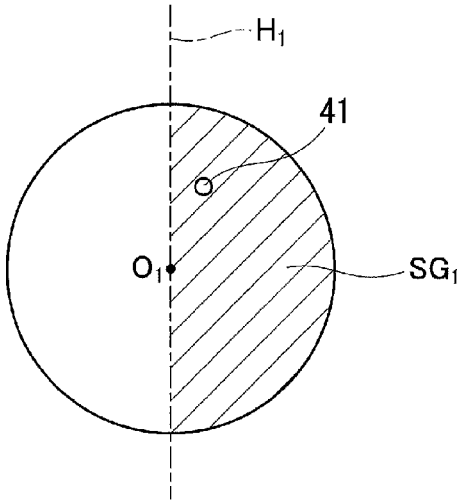
FIG. 5A is a schematic diagram illustrating another method for determining the position of a refrigerant discharge space.
Figure 5B:
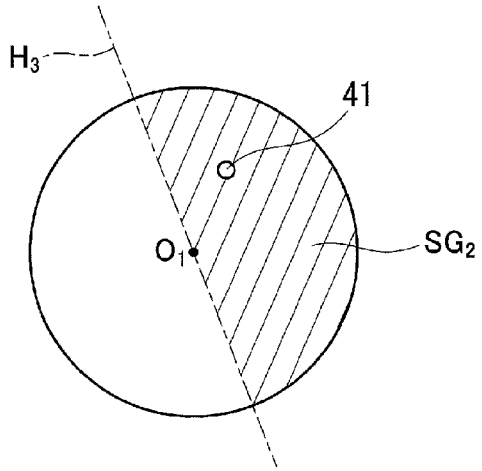
FIG. 5B is a schematic diagram illustrating another method for determining the position of the refrigerant discharge space.
Figure 5C:
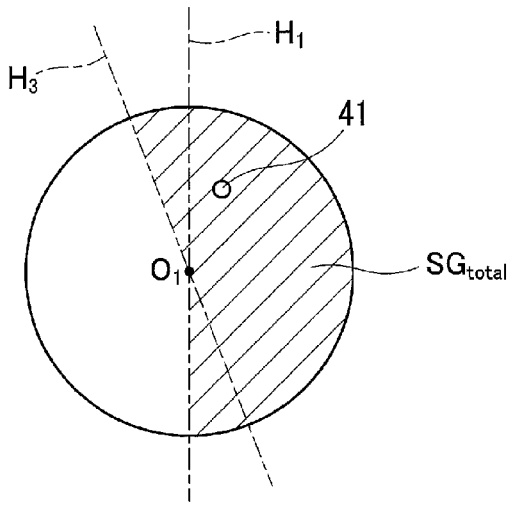
FIG. 5C is a schematic diagram illustrating another method for determining the position of the refrigerant discharge space.

As shown in FIG. 5A, the rotary compressor 100 is divided into two segments by the first reference plane $H_1$, and one of the two segments that includes the second discharge port 41 is defined as a first high-temperature segment $SG_1$ (shaded portion). As shown in FIG. 5B, the rotary compressor 100 is divided into two segments by the third reference plane $H_3$, and one of the two segments that includes the second discharge port 41 is defined as a second high-temperature segment $SG_2$ (shaded portion). As shown in FIG. 5C, the rotary compressor 100 is divided into four segments by the first reference plane $H_1$ and the third reference plane $H_3$, and three of the four segments that are included in the first high-temperature segment $SG_1$ or the second high-temperature segment $SG_2$ are collectively defined as a combined high-temperature segment $SG_{total}$ (shaded portion). In a projection view obtained by projecting the combined high-temperature segment $SG_{total}$ and the refrigerant discharge space 52 onto a plane perpendicular to the central axis $O_1$, for example, 70% or more of the projection region of the refrigerant discharge space 52 may overlap the projection region of the combined high-temperature segment $SG_{total}$. That is, when a part of the refrigerant discharge space 52 is located directly below the second suction port 20, the total loss including the heat loss and the pressure loss is minimized, which may allow the rotary compressor 100 to exhibit the highest efficiency.

Figure 5D:
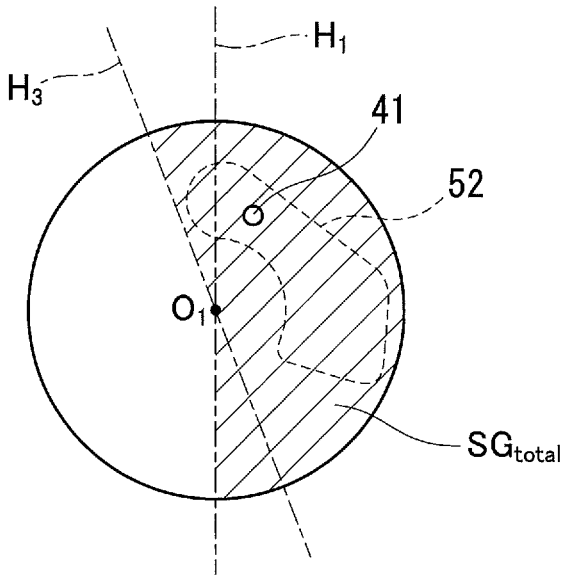
FIG. 5D is a schematic diagram showing another desired position of the refrigerant discharge space.

As shown in FIG. 5D, in a projection view obtained by projecting the combined high-temperature segment $SG_{total}$ and the refrigerant discharge space 52 onto a plane perpendicular to the central axis $O_1$, the entire projection region of the refrigerant discharge space 52 may fall within the projection region of the combined high-temperature segment $SG_{total}$. To put it more simply, the refrigerant discharge space 52 may be formed on the opposite side to the second cylinder chamber 26 with respect to the lower bearing member 72 (below the lower bearing member 72) without extending beyond the third reference plane $H_3$. With such a structure, the effect of suppressing the heat loss is enhanced. If there is no concern about an increase in the pressure loss, such a structure is reasonably acceptable.

Figure 5E:
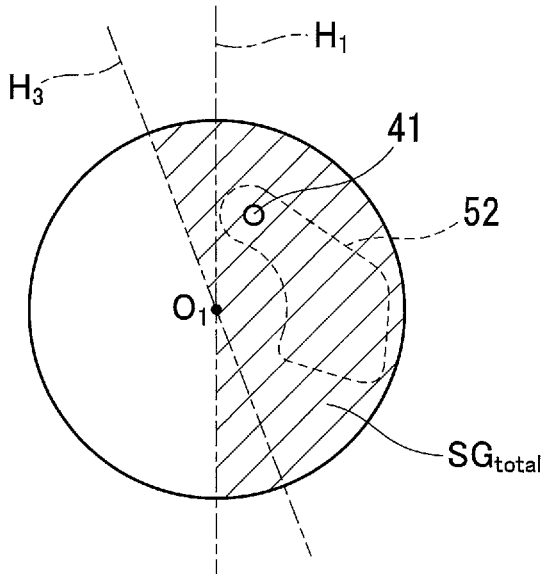
FIG. 5E is a schematic diagram showing still another desired position of the refrigerant discharge space.

In some cases, as shown in FIG. 5E, in a projection view obtained by projecting the first high-temperature segment $SG_1$ and the refrigerant discharge space 52 onto a plane perpendicular to the central axis $O_1$, the entire projection region of the refrigerant discharge space 52 may fall within the projection region of the first high-temperature segment $SG_1$. This means that the refrigerant discharge space 52 may be formed only on the same side as the second discharge port 41 with respect to the first reference plane $H_1$.

Next, another structure that forms the oil retaining portion 53 is described.

Figure 6:
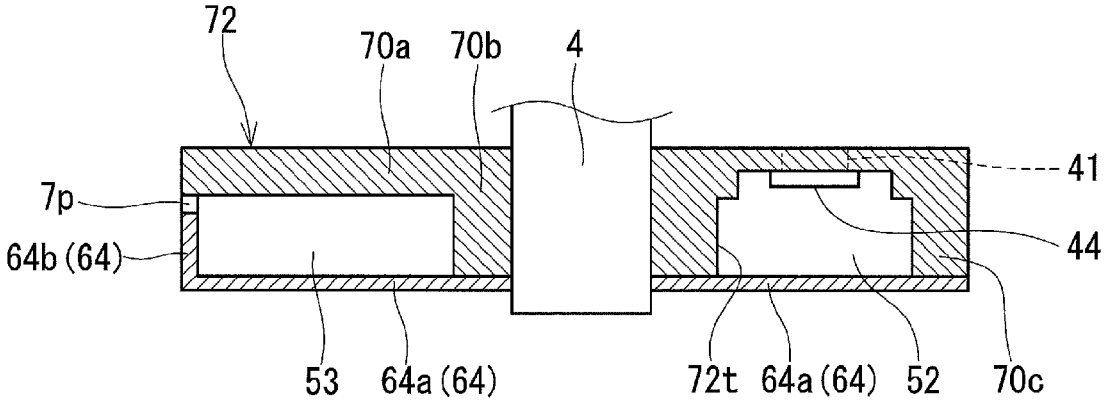
FIG. 6 is a partial cross-sectional view showing another structure that forms an oil retaining portion.

As shown in FIG. 6, the arc-shaped portion 64*b* of the second partition member 64 may extend in a direction parallel to the central axis $O_1$ and be in contact with the lower surface of the lower bearing member 72. The arc-shaped portion 64*b* is provided with a communication path 7*p* to allow the oil to move between the oil reservoir 22 and the oil retaining portion 53. The communication path 7*p* is a hole or a slit, and is provided at a specified position in the arc-shaped portion 64*b*. With such a structure, the route of oil entry into the oil retaining portion 53 is limited.

Hereinafter, the position of the communication path 7*p* is described in detail.

Figure 7:
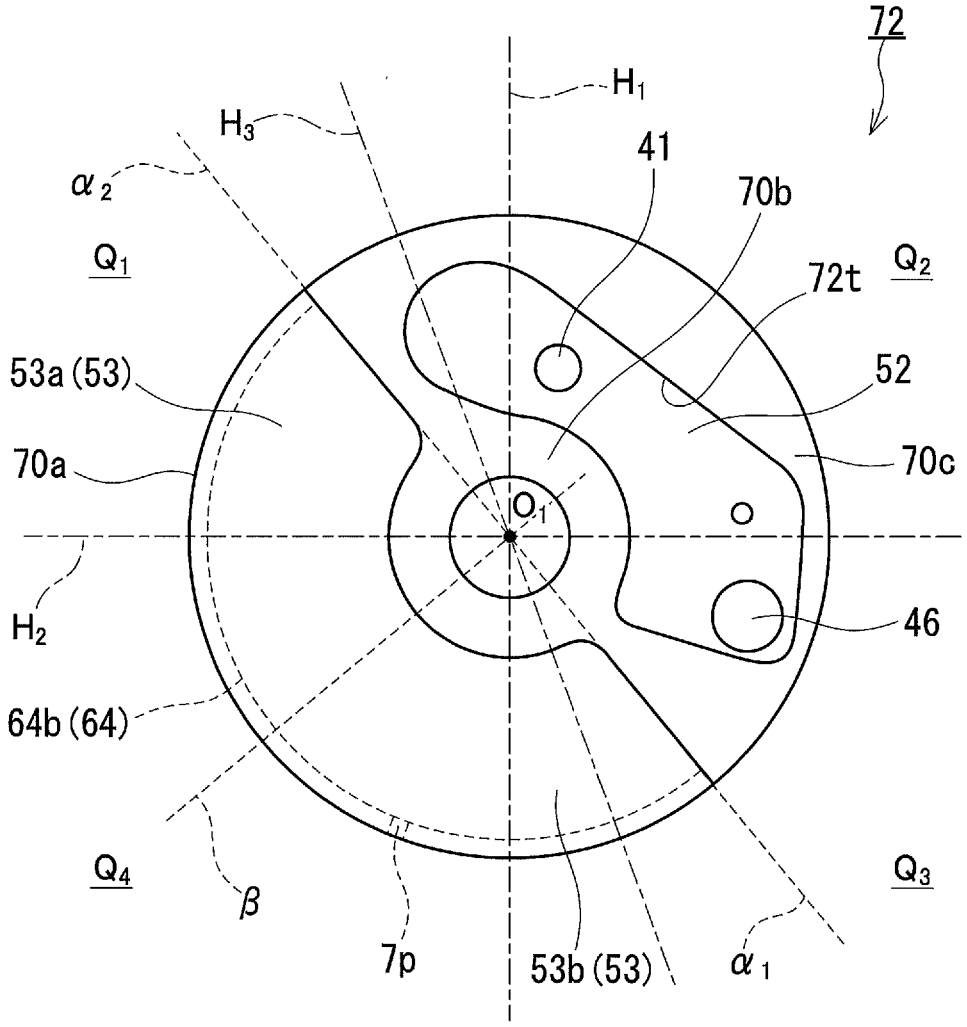
FIG. 7 is a bottom view illustrating the specific position of a communication path.

As shown in FIG. 7, first, two planes each including the central axis $O_1$, each being tangent to the oil retaining portion 53, and forming an angle within which the oil retaining portion 53 is located are defined as tangent planes $\alpha_1$ and $\alpha_2$. A plane including the central axis $O_1$ and bisecting the angle formed between the tangent planes $\alpha_1$ and $\alpha_2$ so as to divide the oil retaining portion 53 into two parts 53*a* and 53*b* is defined as a bisecting plane $\beta$. Among these two parts 53*a* and 53*b* formed by the bisecting plane $\beta$, one part that is located relatively close to the second suction port 20 in the rotational direction of the second piston 28 is defined as an anterior portion 53*a*, and the other part that is located relatively far from the second suction port 20 in the rotational direction of the second piston 28 is defined as a posterior portion 53*b*. The communication path 7*p* communicates the oil reservoir 22 with the posterior portion 53*b* of the oil retaining portion 53. The oil in the oil reservoir 22 cannot flow directly into the anterior portion 53*a* of the oil retaining portion 53. The oil in the oil reservoir 22 flows into the anterior portion 53*a* of the oil retaining portion 53 through the posterior portion 53*b* (desirably, only through the posterior portion 53*b*). When the communication path 7*p* is provided in such a position, the heat reception by the drawn refrigerant can be suppressed more effectively.

During the operation of the rotary compressor 100, the second piston 28 rotates counterclockwise around the central axis $O_1$ shown in FIG. 7. The refrigerant is compressed as it moves from the first quadrant segment $Q_1$ to the fourth quadrant segment $Q_4$, the third quadrant segment $Q_3$, and the second quadrant segment $Q_2$ in this order. Therefore, the temperature of the lower bearing member 72 tends to be lowest in the first quadrant segment $Q_1$ and highest in the second quadrant segment $Q_2$. When the communication path 7*p* is formed only in the posterior portion 53*b* of the oil retaining portion 53, the oil moves mainly between the oil reservoir 22 and the posterior portion 53*b*. That is, since the oil in the anterior portion 53*a* is preferentially allowed to stagnate, the flow speed of the oil in the anterior portion 53*a* is lower than that of the oil in the posterior portion 53*b*. Since the anterior portion 53*a* is located near the second suction port 20, the lower the flow speed of the oil in the anterior portion 53*a* is, the more effectively heat reception by the refrigerant drawn into the second cylinder chamber 26 through the second suction port 20 can be suppressed.

Figure 8:
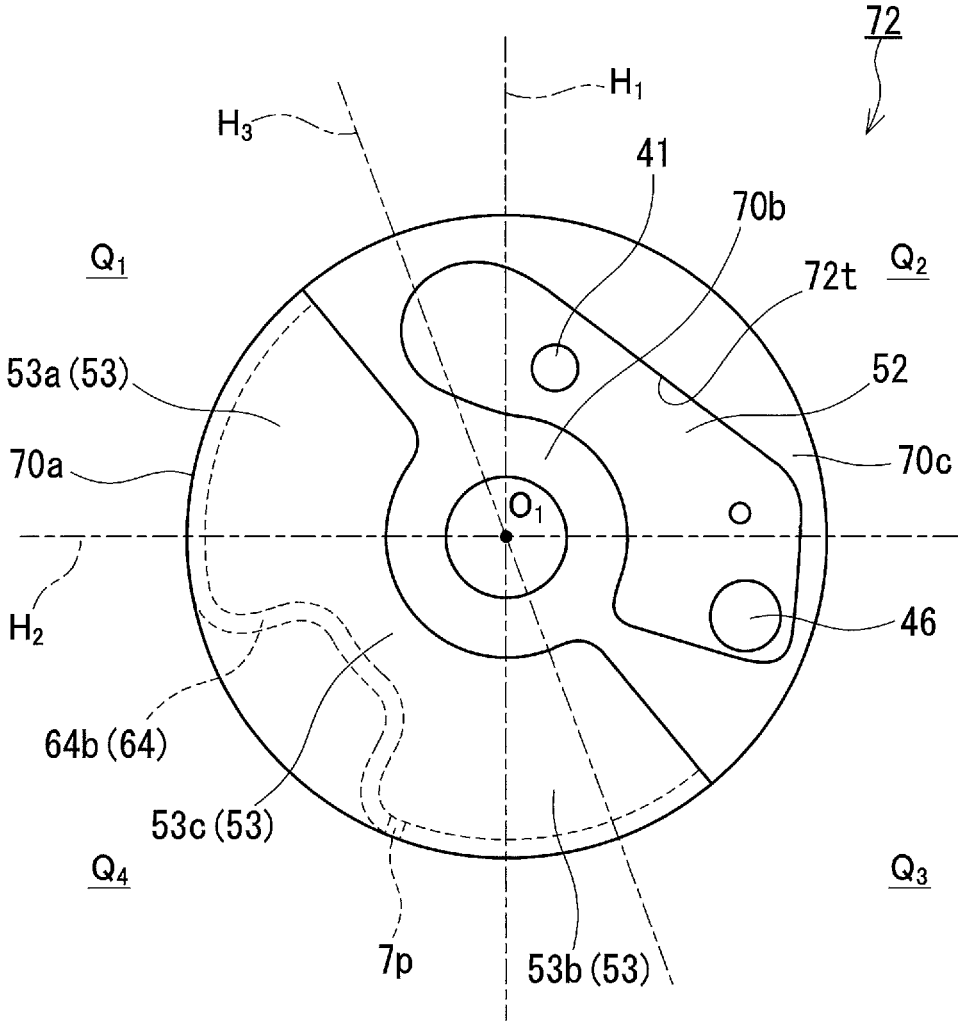
FIG. 8 is a bottom view showing another structure of the oil retaining portion.

As shown in FIG. 8, the oil retaining portion 53 may have the anterior portion 53*a*, the posterior portion 53*b*, and a narrow portion 53*c*. The anterior portion 53*a* is a portion located relatively close to the second suction portion 20 in the rotational direction of the second piston 28. The posterior portion 53*b* is a portion located relatively far from the second suction port 20 in the rotational direction of the second piston 28. The narrow portion 53*c* is a portion located between the anterior portion 53*a* and the posterior portion 53*b*. A part of the arc-shaped portion 64*b* (side wall portion) of the second partition member 64 is recessed toward the central axis $O_1$. This recess forms the narrow portion 53*c*. When the radial direction of the second cylinder 15 is defined as the width direction of the oil retaining portion 53, the width of the narrow portion 53*c* is smaller than that of the anterior portion 53*a* (and the posterior portion 53*b*) in the oil retaining portion 53. When the maximum width of the anterior portion 53*a* and the posterior portion 53*b* is Dmax and the minimum width of the narrow portion 53*c* is Dmin, the ratio (Dmax/Dmin) is, for example, in a range of 1.2 to 50. The narrow portion 53*c* suppresses the movement of the oil between the anterior portion 53*a* and the posterior portion 53*b*. As a result, the flow of the oil in the anterior portion 53*a* is further suppressed, and accordingly heat reception by the drawn refrigerant is also suppressed effectively.

The communication path 7*p* communicates the oil reservoir 22 with the posterior portion 53*b* of the oil retaining portion 53. The oil in the oil reservoir 22 flows into the anterior portion 53*a* only through the posterior portion 53*b* and the narrow portion 53*c*. Thereby, the flow of the oil in the anterior portion 53*a* is effectively suppressed.

The oil retaining portion 53 may be formed by any of the following structures.

Figure 9:
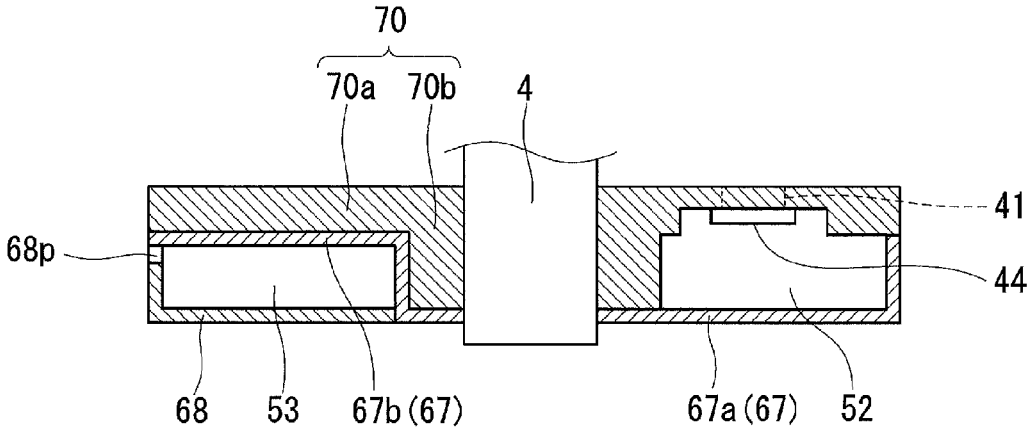
FIG. 9 is a partial cross-sectional view showing still another structure that forms the oil retaining portion.

In the example shown in FIG. 9, a lower bearing member 70 is composed of a circular plate portion 70*a* and a bearing portion 70*b*. The lower bearing member 70 has the same structure as the lower bearing member 72 described with reference to FIG. 4, except that the bank portion 70*c* is omitted. That is, the lower bearing member 70 itself does not have a portion for separating the refrigerant discharge space 52 from the oil retaining portion 53. A second partition member 67 is attached to the lower bearing member 70 so as to form the refrigerant discharge space 52 on the opposite side to the second cylinder chamber 26 with respect to the lower bearing member 70. More specifically, the second partition member 67 is composed of a bowl-shaped portion 67*a* and a flange portion 67*b*. The bowl-shaped portion 67*a* and the flange portion 67*b* constitutes a single component. The bowl-shaped portion 67*a* covers the lower surface of the lower bearing member 70 so as to form the refrigerant discharge space 52 below the lower bearing member 70. The flange portion 67*b* has a shape conforming to the shape of the circular plate portion 70*a* and the bearing portion 70*b* of the lower bearing member 70. The flange portion 67*b* is in close contact with the lower bearing member 70. In addition, an oil cup 68 covers the flange portion 67*b* so as to form the oil retaining portion 53 on the opposite side to the second cylinder chamber 26 with respect to the lower bearing member 70. The oil retaining portion 53 is in contact with the lower surface of the flange portion 67*b*. In the case where the flange portion 67*b* is regarded as a part of the lower bearing member 70, the oil retaining portion 53 is in contact with the lower surface of the lower bearing member 70. The oil cup 68 is provided with a communication path 68*p*. The shape and position of the communication path 68*p* may be the same as those of the communication path 7*p* shown in FIG. 7 and FIG. 8.

According to the structure shown in FIG. 9, the oil retaining portion 53 can be formed using the lower bearing member 70 having the same structure as a lower bearing member of a conventional rotary compressor. The refrigerant discharge space 52 and the oil retaining portion 53 can also be formed by such a structure. Heat transfer from the oil in the oil retaining portion 53 to the refrigerant in the second cylinder chamber 26 can be suppressed more effectively by the flange portion 67*b*.

Figure 10:
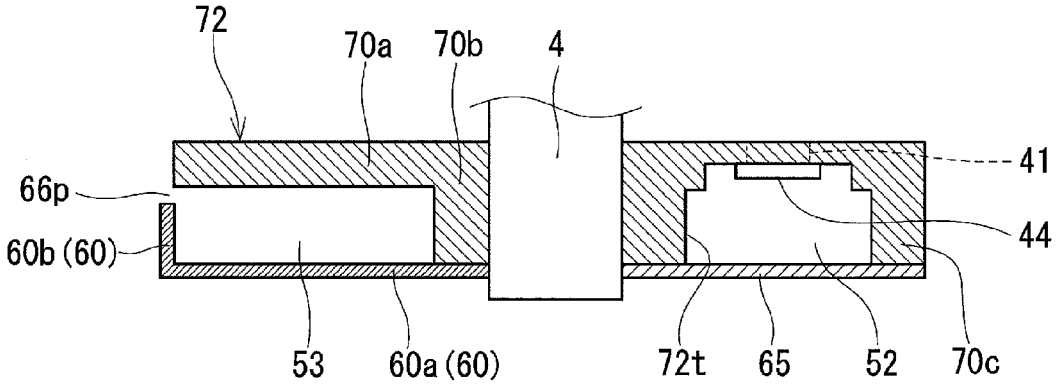
FIG. 10 is a partial cross-sectional view showing still another structure that forms the oil retaining portion.

In an example shown in FIG. 10, the lower bearing member 72 described with reference to FIG. 4 is used. In the example shown in FIG. 10, the refrigerant discharge space 52 is formed by attaching a fan-shaped and plate-like second partition member 65 to the lower bearing member 72. The second partition member 65 is in contact with the bank portion 70*c* and closes the recess 72*t* surrounded by the bearing portion 70*b* and the bank portion 70*c*. In the example shown in FIG. 10, an oil cup 60 is used as a member other than the second partition member 65. The oil cup 60 is attached to the lower bearing member 72 so as to form the oil retaining portion 53. More specifically, when the oil cup 60 is attached to the lower bearing member 72, a space enclosed by the oil cup 60 and the lower bearing member 72 is formed at a position adjacent to the lower bearing member 72. The oil flows into the enclosed space, and thereby the oil retaining portion 53 is formed. The oil cup 60 is composed of a plate-like portion 60*a* and an arc-shaped portion 60*b*. The plate-like portion 60*a* is a portion that faces the circular plate portion 70*a* of the lower bearing member 72. The arc-shaped portion 60*b* is a portion that is formed integrally with the plate-like portion 60*a*, and is formed along the outer edge of the plate-like portion 60*a*. The arc-shaped portion 60*b* further extends in the thickness direction of the plate-like portion 60*a* (in a direction parallel to the rotational axis of the shaft 4). A gap 66*p* serving as a communication path communicating the oil reservoir 22 with the oil retaining portion 53 is formed between the end of the arc-shaped portion 60*b* and the lower bearing member 72.

Figure 11:
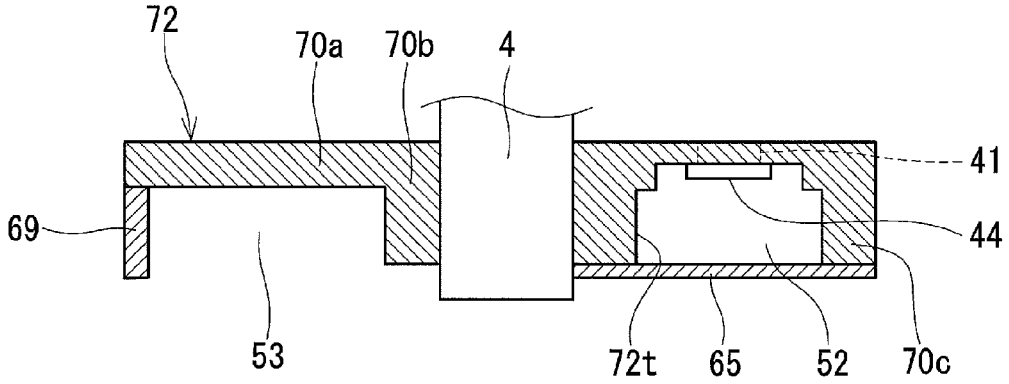
FIG. 11 is a partial cross-sectional view showing still another structure that forms the oil retaining portion.

According to the structures described with reference to FIG. 1, FIG. 6, FIG. 9, and FIG. 10, the lower surface of the lower bearing member 72 or 70 is covered by the second partition member 64, 65, or 67 (or the oil cup 60 or 68). Thereby, the oil retaining portion 53 is formed adjacent to the lower bearing member 72 or 70. However, the lower surface of the lower bearing member 72 or 70 does not necessarily need to be covered as long as the flow speed of the oil can be reduced. As shown in FIG. 11, a space surrounded by a side wall member 69 (another member) and the lower bearing member 72 may be formed at a position adjacent to the lower bearing member 72 by attaching the side wall member 69 to the outer edge portion of the lower bearing member 72, so that the oil flows into the enclosed space and thereby the oil retaining portion 53 is formed. The side wall member 69 extends in the thickness direction of the lower bearing member 72, that is, in the direction parallel to the central axis $O_1$ of the second cylinder 15. The oil retaining portion 53 is a recessed space surrounded by the lower bearing member 72 and the side wall portion 69, and such a space serves to allow the oil to stagnate.

The rotary compressor 100 of the present embodiment is a vertical rotary compressor. During the operation of the rotary compressor 100, the rotational axis of the shaft 4 is parallel to the direction of gravity, and the oil reservoir 22 is formed at the bottom of the closed casing 1. During the operation of the rotary compressor 100, the upper portion of the oil in the oil reservoir 22 has a relatively high temperature and the lower portion of the oil in the oil reservoir 22 has a relatively low temperature. Therefore, in the vertical rotary compressor 100, it is desirable to form the oil retaining portion 53 below the lower bearing member 72 (or 70).

First Modification

Figure 12:
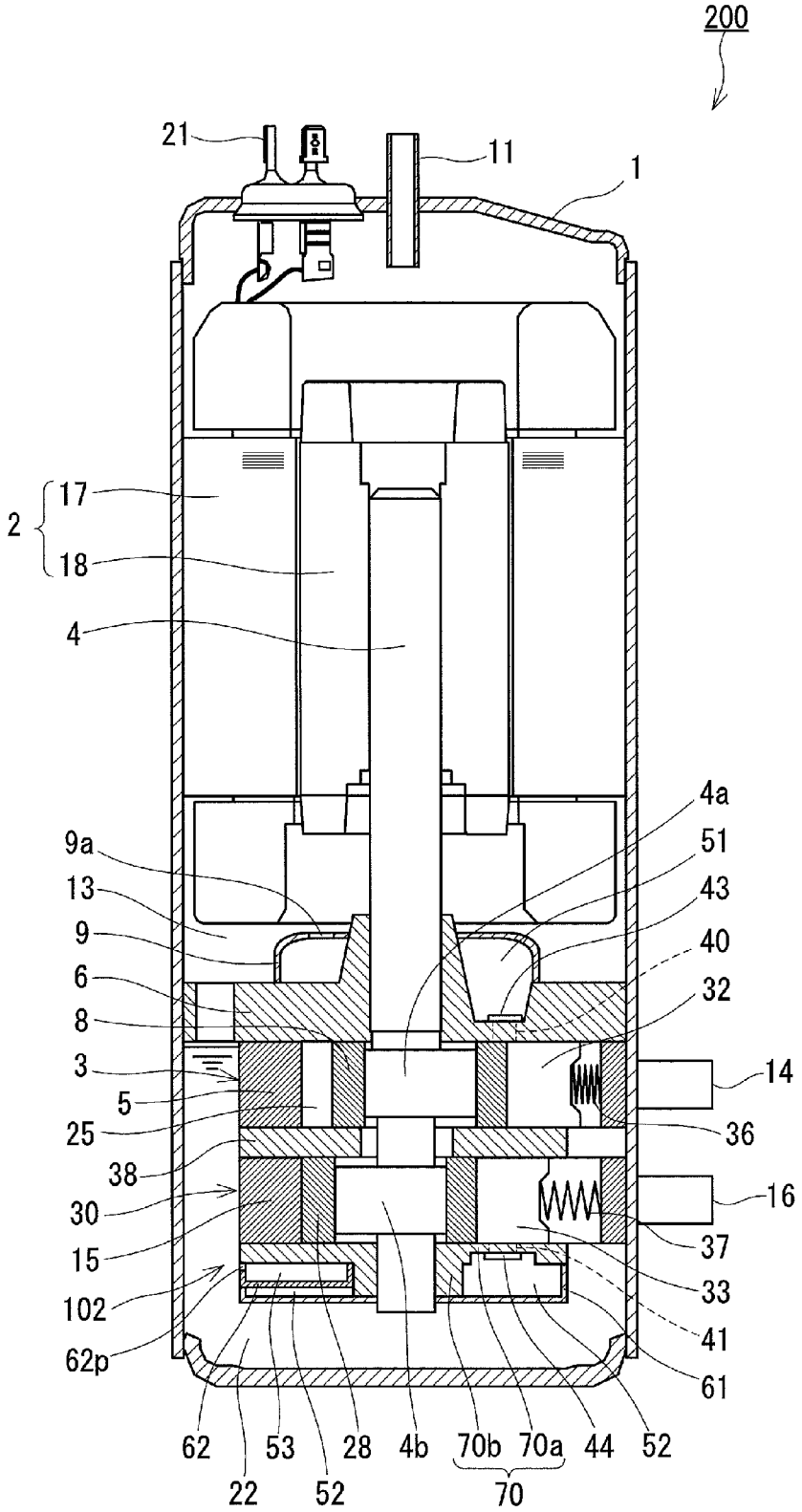
FIG. 12 a longitudinal cross-sectional view of a rotary compressor according to a first modification.

As shown in FIG. 12, a rotary compressor 200 according to a first modification includes a lower bearing member 70, a second partition member 61, and an oil cup 62. The rotary compressor 200 and the rotary compressor 100 shown in FIG. 1 have the same fundamental structure required to compress a refrigerant. The difference between these compressors is a structure for reducing heat loss.

In the present modification, the lower bearing member 70 is composed of a circular plate portion 70*a* and a bearing portion 70*b*. The lower bearing member 70 has the same structure as the lower bearing member 72 described with reference to FIG. 4, except that the bank portion 70*c* is omitted. A second partition member 61 is a member of a bowl-shaped structure, and is attached to the lower bearing member 70 so as to form the refrigerant discharge space 52 on the opposite side to the second cylinder chamber 26 with respect to the lower bearing member 70. More specifically, the second partition member 61 covers the lower surface of the lower bearing member 70 so as to form the refrigerant discharge space 52 below the lower bearing member 70. A through hole for exposing the lower end of the shaft 4 to the oil reservoir 22 is formed at the central portion of the second partition member 61. Basically, the refrigerant discharge space 52 is formed around the entire circumference of the bearing portion 70*b*.

In the present modification, the oil cup 62 is additionally disposed inside the second partition member 61. A certain area of the lower surface of the lower bearing member 70 is covered by the oil cup 62, and thereby the oil retaining portion 53 is formed. The position of the oil retaining portion 53 is as described above with reference to FIG. 1 to FIG. 4. One or a plurality of communication paths 62*p* are formed in the oil cup 62. The oil in the oil reservoir 22 can flow into the oil retaining portion 53 through the communication path(s) 62*p*. As just described, in the present modification, a double shell structure is adopted as a structure for forming the oil retaining portion 53. That is, there is no particular limitation on the means, structure, etc. for forming the oil retaining portion 53. The effect obtained by the rotary compressor 100 referring to FIG. 1 can also be obtained by the rotary compressor 200 of the first modification.

Second Modification

Figure 13:
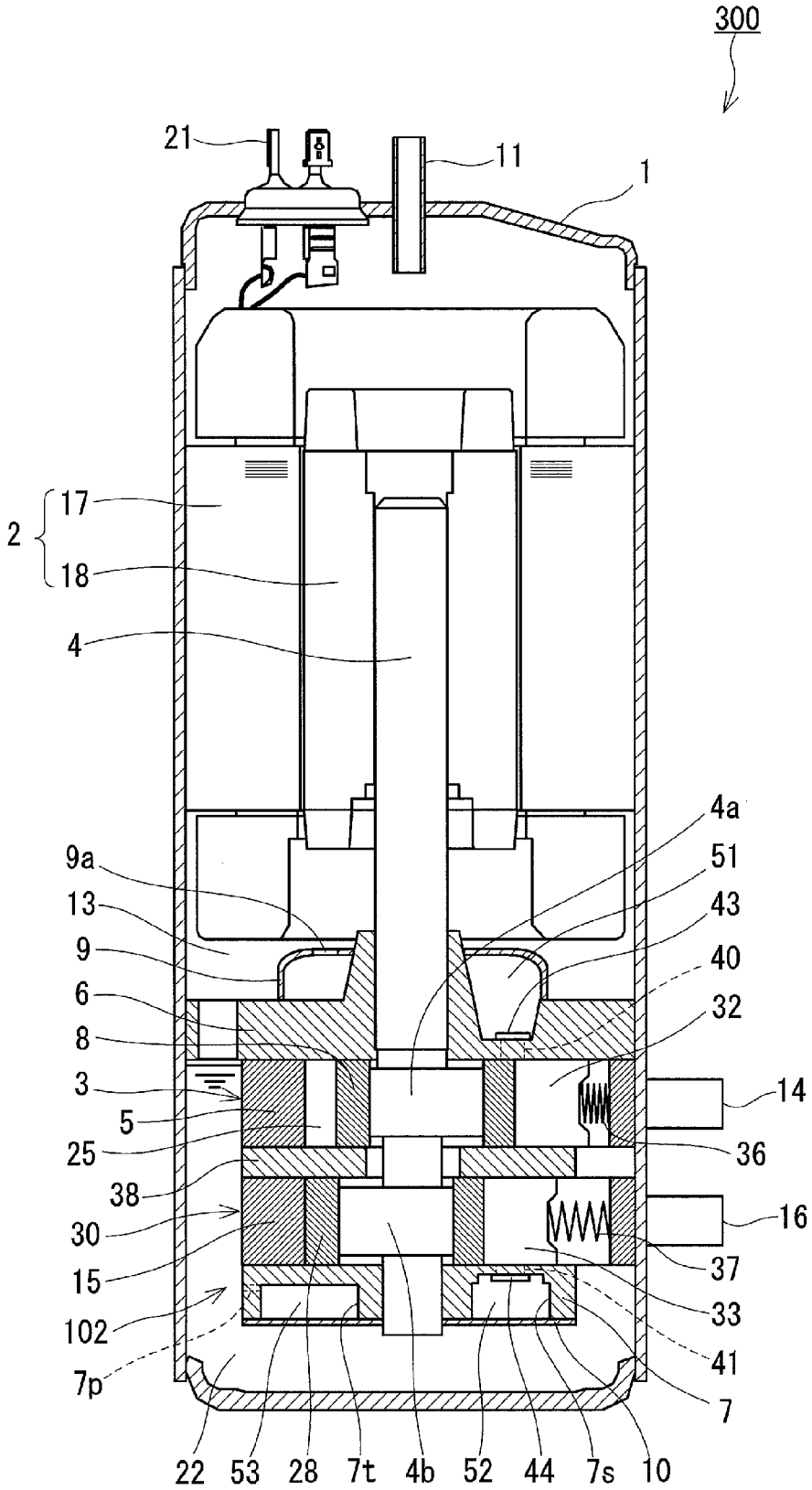
FIG. 13 is a longitudinal cross-sectional view of a rotary compressor according to a second modification.
Figure 15:
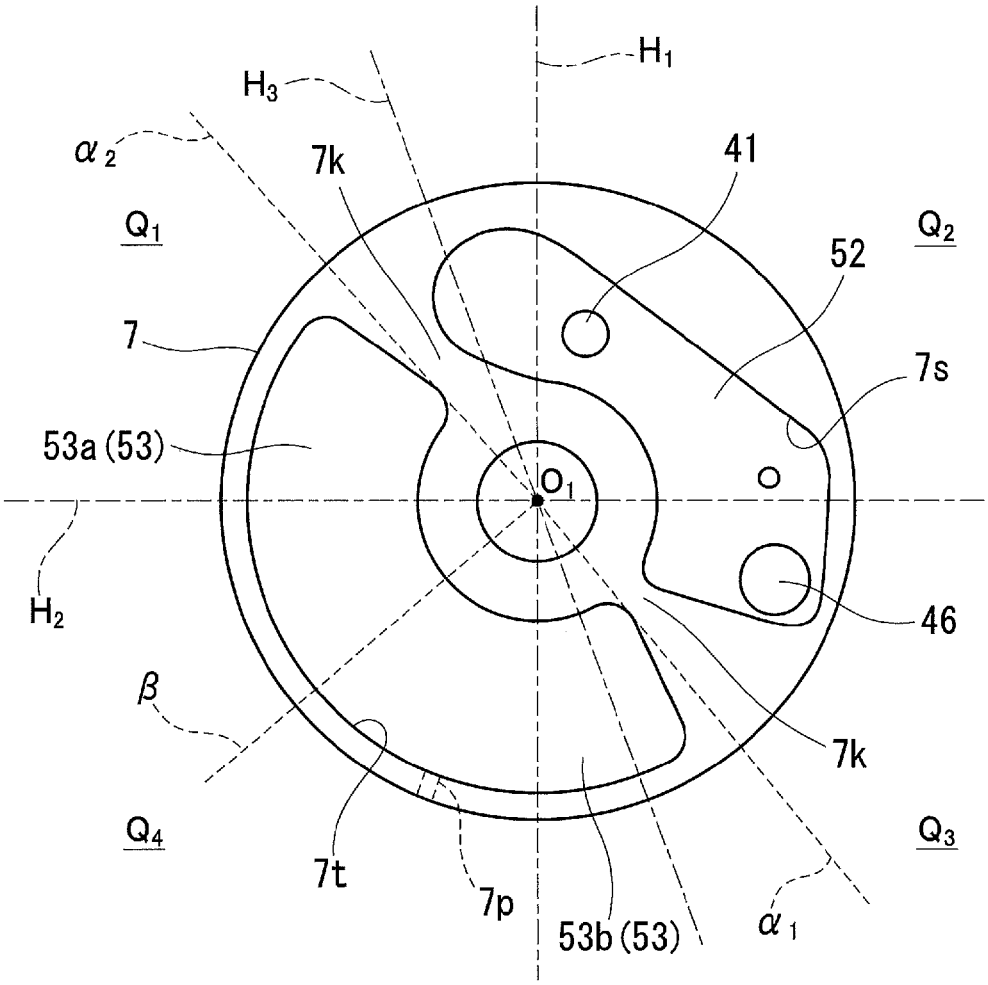
FIG. 15 is a bottom view of a lower bearing member.

As shown in FIG. 13 and FIG. 15, in the present modification, the oil retaining portion 53 is formed by closing the first recess 7*t* provided in the lower bearing member 7 by the second partition member 10 and by allowing the oil in the oil reservoir 22 to flow into the first recess 7*t*. With such a structure, it is possible to avoid an excessive increase in the thickness of the lower bearing member 7, which not only makes it possible to avoid an increase in the cost of components but also is advantageous in reducing the weight of the rotary compressor 100. However, the oil retaining portion 53 may be formed by closing the first recess 7*t* by a member other than the second partition member 10.

The lower bearing member 7 further has a communication path 7*p* formed therein. The communication path 7*p* extends in a lateral direction so as to communicate the oil reservoir 22 with the oil retaining portion 53. The oil in the oil reservoir 22 can flow into the oil retaining portion 53 through the communication path 7*p* (communication hole). When a plurality of communication paths 7*p* are provided, the oil in the oil reservoir 22 can surely flow into the oil retaining portion 53. In order to minimize the movement of the oil between the oil retaining portion 53 and the oil reservoir 22, only one communication path 7*p* may be provided in the lower bearing member 7.

Figure 14:
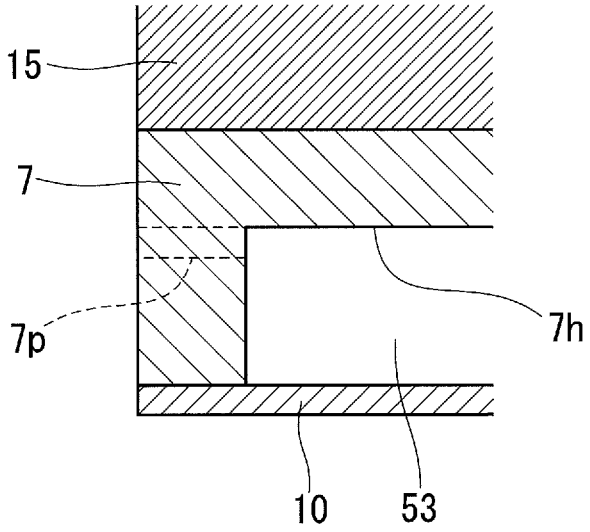
FIG. 14 is an enlarged cross-sectional view showing the position of the communication path.

In the present modification, the communication path 7*p* is formed of a small through hole. However, the communication path 7*p* may be formed of another structure such as a slit. As shown in FIG. 14, in a direction parallel to the rotational axis of the shaft 4, the upper end of the communication path 7*p* is located at the same level as the lower surface 7*h* of the lower bearing member 7, or is located at a higher level than the lower surface 7*h* of the lower bearing member 7. With such a structure, it is possible to prevent air from remaining in the oil retaining portion 53.

The refrigerant discharge space 52 is formed by closing the second recess 7*s* provided in the lower bearing member 7 by the second partition member 10. That is, the first recess 7*t* serving as the oil retaining portion 53 and the second recess 7*s* serving as the refrigerant discharge space 52 are formed in the lower bearing member 7. The second partition member 10 includes a single plate-like member. Both the first recess 7*t* and the second recess 7*s* are closed by the second partition member 10. In the present modification, the lower surface of the second partition member 10 is a flat surface. The open end face of the first recess 7*t* and the open end face of the second recess 7*s* are on the same plane so that both of the first recess 7*t* and the second recess 7*s* can be closed by the second partition member 10. This structure is very simple and therefore an increase in the number of components can also be avoided.

As shown in FIG. 15, the oil retaining portion 53 is formed in a certain angular range around the shaft 4, and the refrigerant discharge space 52 is formed in the remaining angular range. However, a part of the oil retaining portion 53 and a part of the refrigerant discharge space may overlap each other in the circumferential direction of the shaft 4. The oil retaining portion 53 is completely separated from the refrigerant discharge space 52 by ribs 7*k* provided on the lower bearing member 7. The detailed positions of the refrigerant discharge space 52 and the oil retaining portion 53 are as described above.

Figure 16:
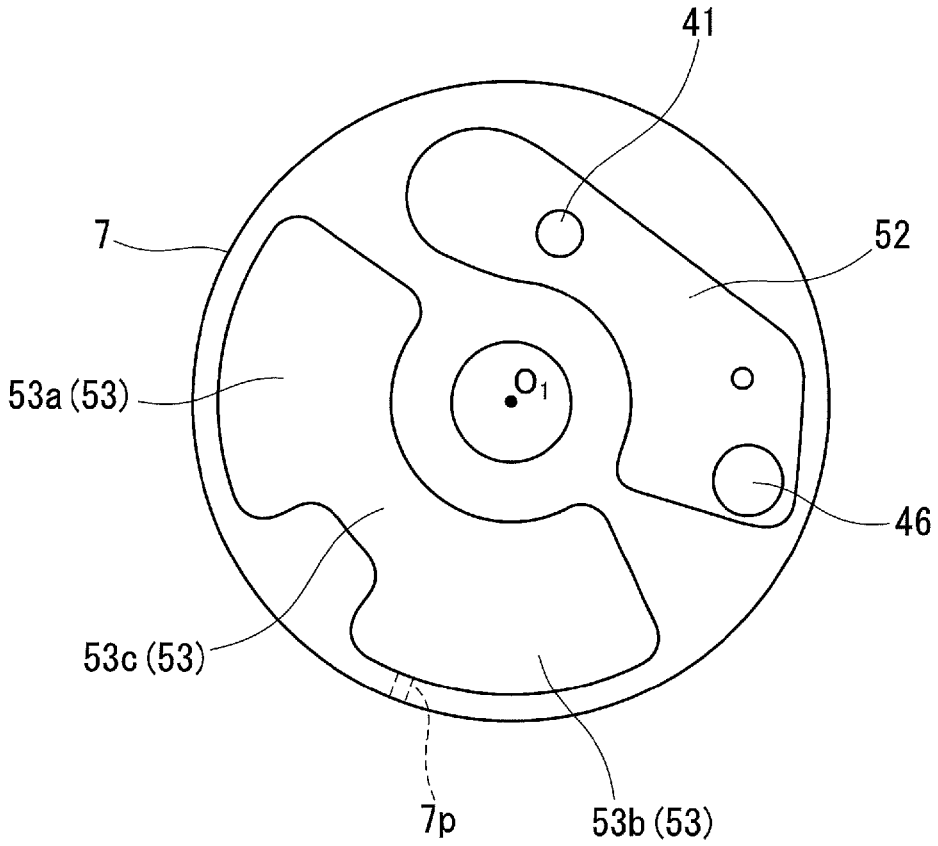
FIG. 16 is a bottom view showing another structure of the oil retaining portion.

As shown in FIG. 16, also in this modification, the oil retaining portion 53 may have the narrow portion 53*c*.

Figure 17:
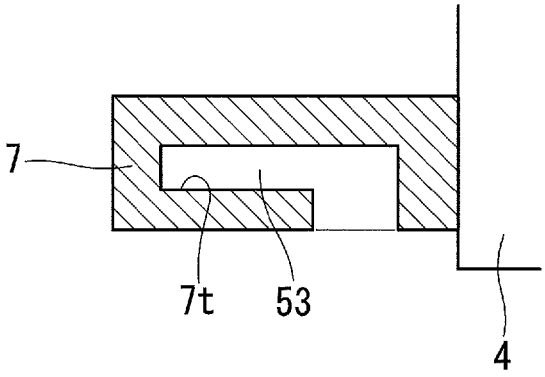
FIG. 17 is a partially enlarged cross-sectional view showing still another structure of the oil retaining portion.

In the present modification, the first recess 7*t* provided in the lower bearing member 7 is closed by the second partition member 10 and thereby the oil retaining portion 53 is formed. However, the oil retaining portion 53 may be formed only by the first recess 7*t* provided in the lower bearing member 7 as long as the flow speed of the oil can be reduced. This means that the oil retaining portion 53 can have a structure that does not require the second partition member 10. For example, in the case where the first recess 7*t* has a sufficiently large depth (or volume), the first recess 7*t* serves to allow the oil to stagnate. Therefore, the flow speed of the oil in the first recess 7*t* is lower than that of the oil in the oil reservoir 22. In the case where the first recess 7*t* is formed in a hook shape as shown in FIG. 17, the flow speed of the oil in the first recess 7*t* is sufficiently lower than that of the oil in the oil reservoir 22. In these structures, the first recess 7*t* does not necessarily need to be closed by the second partition member 10.

Third Modification

Figure 18:
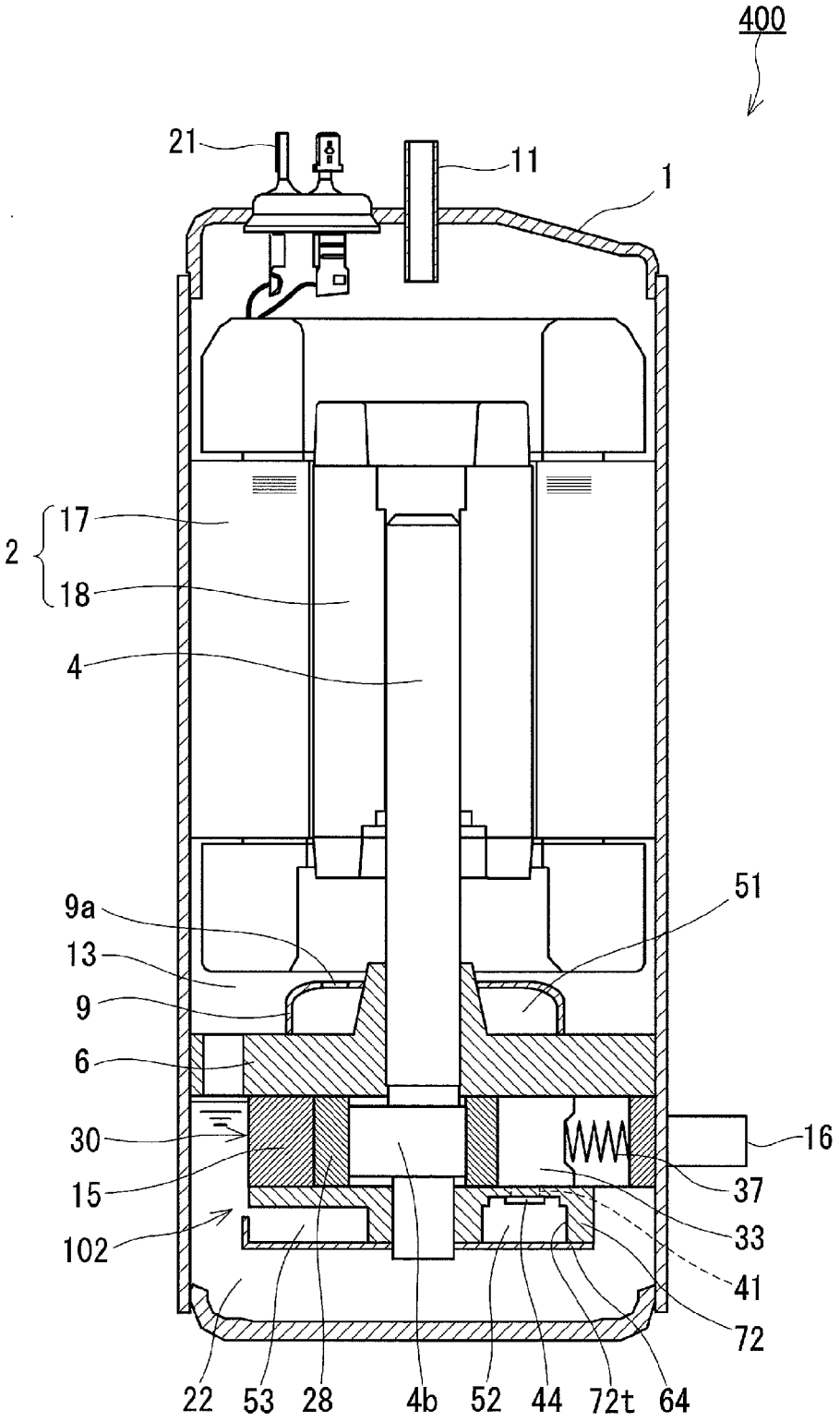
FIG. 18 is a longitudinal cross-sectional view of a rotary compressor according to a third modification.

As shown in FIG. 18, a rotary compressor 400 according to a third modification has the same structure as the rotary compressor 100 shown in FIG. 1 except that the first compression block 3 is omitted. That is, the rotary compressor 300 is a single-piston rotary compressor including only one cylinder. Thus, the present invention can also be applied to the single-piston rotary compressor 400.

Fourth Modification

Figure 19:
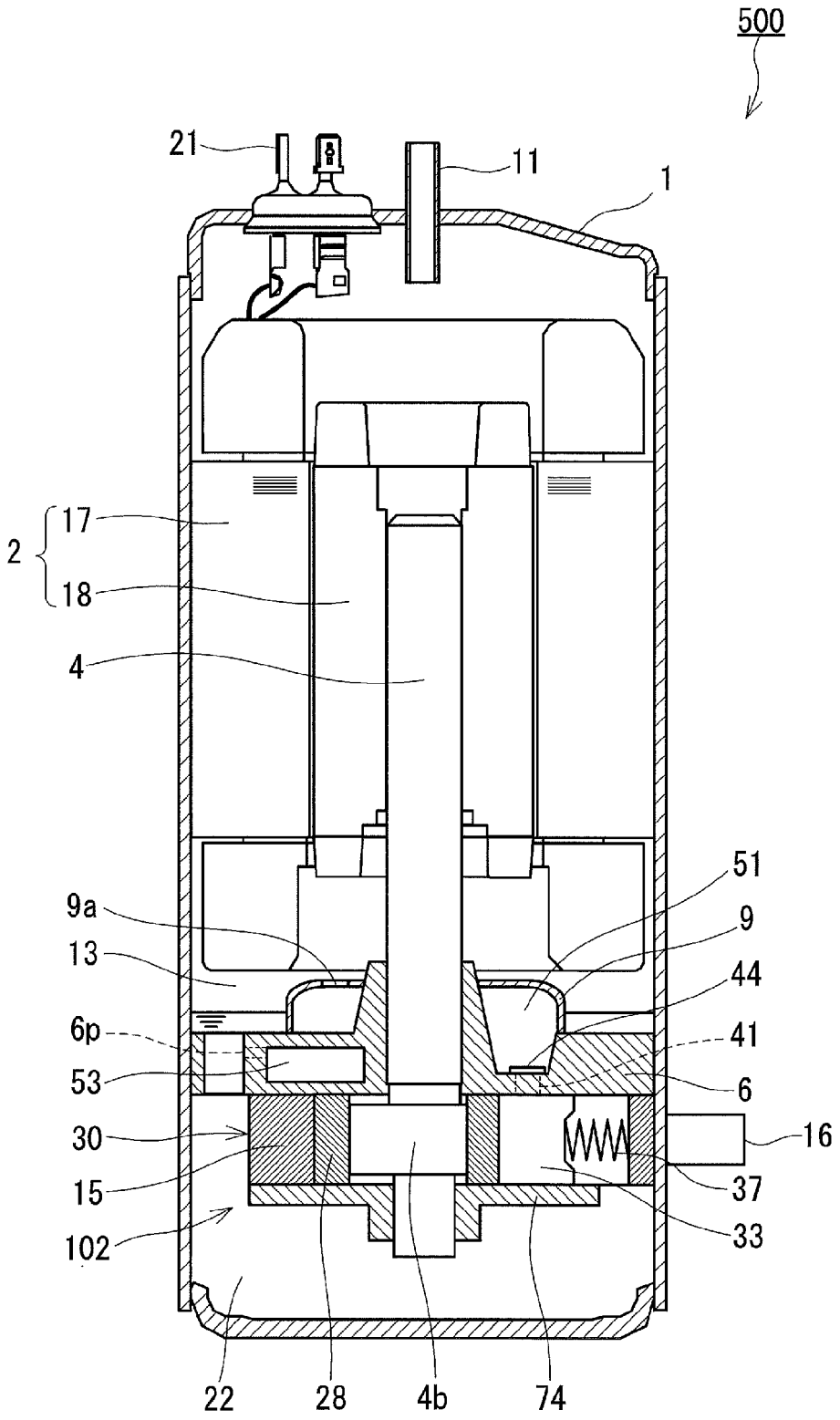
FIG. 19 is a longitudinal cross-sectional view of a rotary compressor according to a fourth modification.

As shown in FIG. 19, a rotary compressor 500 according to a fourth modification includes the oil retaining portion 53 provided inside the upper bearing member 6. According to the structure described with reference to FIG. 12, it is also possible to form the oil retaining portion 53 above the upper bearing member 6. Thus, the oil retaining portion 53 may be formed above or below the cylinder chamber 26.

Fifth Modification

Figure 20:
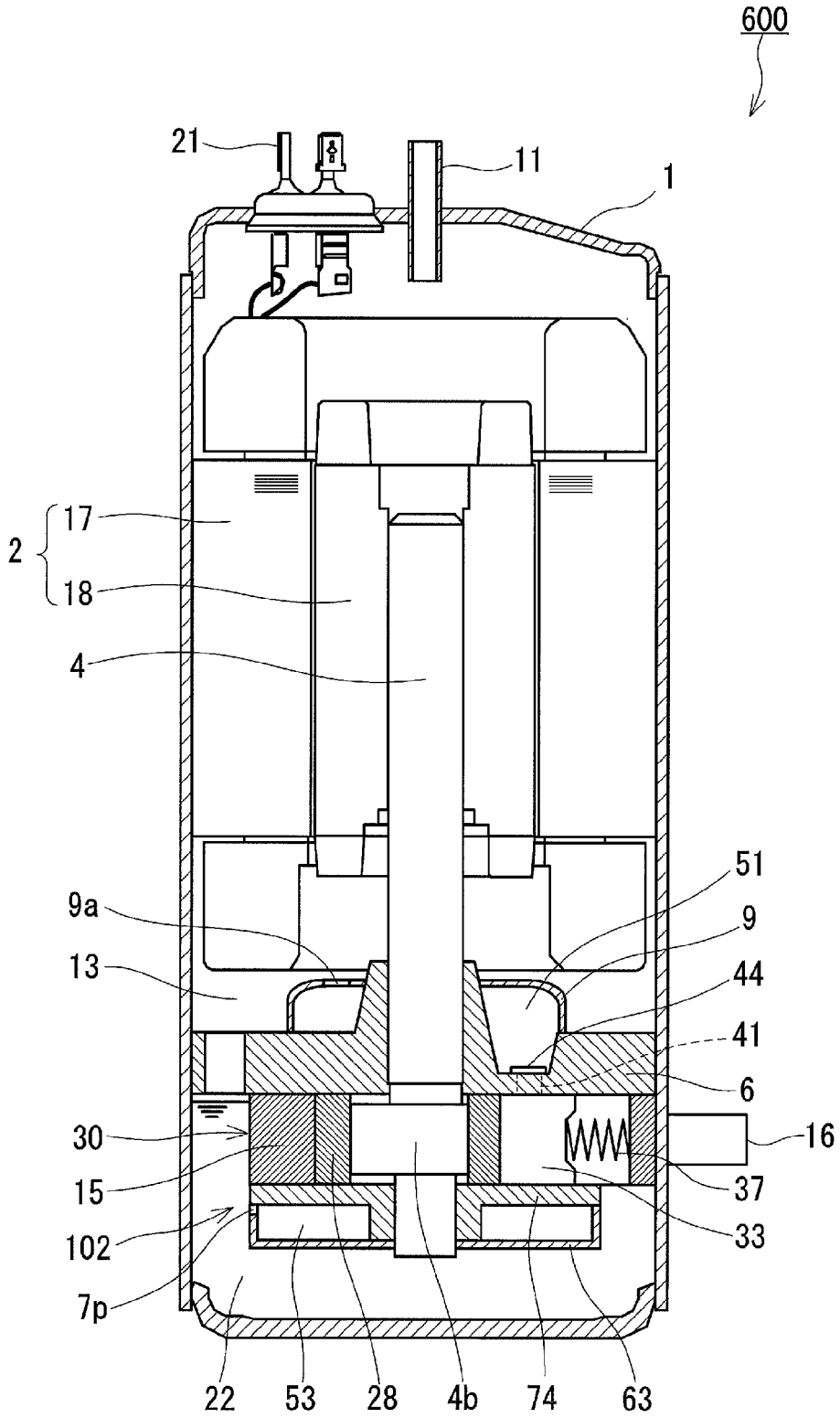
FIG. 20 is a longitudinal cross-sectional view of a rotary compressor according to a fifth modification.

As shown in FIG. 20, a rotary compressor 600 according to a fifth modification is a single-piston rotary compressor. The compressed refrigerant is discharged from the compression chamber 26 to the refrigerant discharge space 51 through the discharge port 41 formed in the upper bearing member 6. An oil cup 63 is attached to the lower bearing member 74. Thereby, a space enclosed by the lower bearing member 74 and the oil cup 63 is formed below the lower bearing member 74. The oil flows into the enclosed space, and thereby the oil retaining portion 53 is formed. Thus, the oil retaining portion 53 can also be provided in the single-piston rotary compressor 600. In the present modification, the refrigerant discharge space is not present below the lower bearing member 70. Therefore, the oil retaining portion 53 may be formed in the entire angular range around the shaft 4. The oil retaining portion 53 may be formed only in a certain angular range around the shaft 4.

INDUSTRIAL APPLICABILITY

The present invention is useful for compressors of refrigeration cycle apparatuses that can be used in electrical appliances such as hot water dispensers, hot-water heaters, and air conditioners.

The invention claimed is:

1. A rotary compressor comprising:
- a closed casing comprising an oil reservoir;
- a cylinder disposed inside the closed casing;
- a piston disposed inside the cylinder;
- a bearing member attached to the cylinder so as to form a cylinder chamber between the cylinder and the piston;
- a vane that partitions the cylinder chamber into a suction chamber and a discharge chamber;
- a suction port through which a refrigerant to be compressed is introduced into the suction chamber;
- a discharge port through which the compressed refrigerant is discharged from the discharge chamber, the discharge port being formed in the bearing member; and
- a partition member attached to the bearing member so as to form, together with the bearing member, a refrigerant discharge space adapted to retain the refrigerant discharged from the discharge chamber through the discharge port, wherein
- the partition member or a closing member is attached to the bearing member so as to form a space enclosed by the partition member and the bearing member or a space enclosed by the closing member and the bearing member at a position adjacent to the bearing member,
- a portion of an oil stored in an oil reservoir flows into the enclosed space, and thereby an oil retaining portion is formed, and
- the oil retaining portion is located on the same side as the suction port with respect to a reference plane, the reference plane being a plane including a central axis of the cylinder and a center of the vane when the vane protrudes maximally toward the central axis of the cylinder.

2. The rotary compressor according to claim 1, wherein the closing member is an oil cup that covers the bearing member so as to form the oil retaining portion.

3. The rotary compressor according to claim 1, further comprising a shaft to which the piston is fitted, wherein
- the bearing member comprises a circular plate portion adjacent to the cylinder, a bearing portion formed integrally with the circular plate portion so as to support the shaft, and a bank portion protruding from the circular plate portion so as to surround a recess adapted to serve as the refrigerant discharge space, and
- the recess is closed by the partition member so as to form the refrigerant discharge space.

4. The rotary compressor according to claim 1, wherein
- the closing member is an oil cup that covers the bearing member so as to form the oil retaining portion,
- the partition member covers the hearing member so as to form the refrigerant discharge space, and
- the oil cup is disposed inside the partition member.

5. The rotary compressor according to claim 1, further comprising a communication path that communicates the oil reservoir with the oil retaining portion.

6. The rotary compressor according to claim 5, wherein when two planes each including the central axis, each being tangent to the oil retaining portion, and forming an angle within which the oil retaining portion is located are defined as tangent planes, a plane including the central axis and bisecting the angle so as to divide the oil retaining portion into two parts is defined as a bisecting plane, and one of the two parts formed by the bisecting plane is defined as an anterior portion located relatively close to the suction port in a rotational direction of the piston and the other part is defined as a posterior portion located relatively far from the suction port in the rotational direction of the piston, the communication path communicates the oil reservoir with the posterior portion, and the oil in the oil reservoir flows into the anterior portion only through the posterior portion.

7. The rotary compressor according to claim 1, wherein the oil retaining portion comprises an anterior portion located relatively close to the suction port in a rotational direction of the piston, a posterior portion located relatively far from the suction port in the rotational direction of the piston, and a narrow portion located between the anterior portion and the posterior portion.

8. The rotary compressor according to claim 7, further comprising a communication path that communicates the oil reservoir with the oil retaining portion, wherein the communication path communicates the oil reservoir with the posterior portion, and the oil in the oil reservoir flows into the anterior portion only through the posterior portion and the narrow portion.

9. The rotary compressor according to claim 1, wherein the bearing member is provided with a recess and the recess is closed by the partition member so as to form the refrigerant discharge space, and the bearing member has a larger thickness in the oil retaining portion than in the recess.

10. The rotary compressor according to claim 1, wherein in a projection view obtained by projecting the refrigerant discharge space and the oil retaining portion onto a plane perpendicular to the central axis, a projection region of the refrigerant discharge space has a smaller area than a projection region of the oil retaining portion.

11. The rotary compressor according to claim 1, wherein when (i) the reference plane is defined as a first reference plane, (ii) a plane including the central axis and perpendicular to the first reference plane is defined as a second reference plane, and (iii) four segments obtained by dividing the rotary compressor by the first reference plane and the second reference plane are defined as a first quadrant segment including the suction port, a second quadrant segment including the discharge port, a third quadrant segment opposite to the first quadrant segment and adjacent to the second quadrant segment, and a fourth quadrant segment opposite to the second quadrant segment and adjacent to the first quadrant segment, respectively, in a projection view obtained by projecting the first to fourth quadrant segments and the refrigerant discharge space on to a plane perpendicular to the central axis, an entire projection region of the refrigerant discharge space falls within a combined region consisting of a projection region of the first quadrant segment, a projection region of the second quadrant segment, and a projection region of the third quadrant segment.

12. The rotary compressor according to claim 1, wherein when (a) the reference plane is defined as a first reference plane, (b) a plane including the central axis and a center of the suction port is defined as a third reference plane, (c) one of two segments obtained by dividing the rotary compressor by the first reference plane is defined as a first high-temperature segment including the discharge port, (d) one of two segments obtained by dividing the rotary compressor by the third reference plane is defined as a second high-temperature segment including the discharge port, and (e) three of four segments obtained by dividing the rotary compressor by the first reference plane and the third reference plane are collectively defined as a combined high-temperature segment, the three segments being included in the first high-temperature segment or the second high-temperature segment, in a projection view obtained by projecting, the combined high-temperature segment and the refrigerant discharge space onto a plane perpendicular to the central axis, 70% or more of a projection region of the refrigerant discharge space overlaps a projection region of the combined high-temperature segment.

13. The rotary compressor according to claim 1, further comprising a shaft to which the piston is fitted, wherein the rotary compressor is a vertical rotary compressor in which a rotational axis of the shaft is parallel to a direction of gravity and the oil reservoir is formed at a bottom of the closed casing.

* * * * *